US005421719A

United States Patent [19]

Saito et al.

[11] Patent Number: 5,421,719

[45] Date of Patent: Jun. 6, 1995

[54] CATALYTIC COMBUSTION APPARATUS AND METHOD

[75] Inventors: Kazuo Saito; Katsuyoshi Kumazawa, both of Tokyo, Japan

[73] Assignee: Kabushiki Kaisha Toshiba, Kawasaki, Japan

[21] Appl. No.: 926,001

[22] Filed: Aug. 10, 1992

[30] Foreign Application Priority Data

Aug. 26, 1991 [JP] Japan ..... 3-213530

[51] Int. Cl.[6] ..... F23D 3/40

[52] U.S. Cl. ..... 431/7; 431/258; 431/328; 431/67; 422/174; 60/300; 126/92 AC

[58] Field of Search ..... 431/7, 258, 328, 329, 431/67; 422/174; 60/300; 126/92 AC, 92 A, 92 C

[56] References Cited

U.S. PATENT DOCUMENTS

| | | | |
|---|---|---|---|
| 2,999,534 | 9/1961 | Wagner | 431/328 |
| 3,057,400 | 10/1962 | Wagner | 431/329 |
| 3,199,505 | 8/1965 | Lloyd | 431/328 |
| 3,610,791 | 10/1971 | Iacaccia | 431/329 |
| 3,770,389 | 10/1973 | Kitzner et al. | 60/300 |
| 3,886,739 | 6/1975 | Lee | 60/300 |
| 4,485,621 | 12/1984 | Wong et al. | 60/274 |
| 4,676,737 | 6/1987 | Suzuki et al. | 431/328 |
| 5,158,448 | 10/1992 | Kawasaki et al. | 431/328 |
| 5,163,290 | 11/1992 | Kinnear | 60/300 |
| 5,204,066 | 4/1993 | Fumio et al. | 422/174 |

FOREIGN PATENT DOCUMENTS

| | | |
|---|---|---|
| 0419906 | 4/1991 | European Pat. Off. . |
| 1211081 | 3/1960 | France . |
| 2-213080 | 8/1990 | Japan . |
| 2-223622 | 9/1990 | Japan . |
| 678020A5 | 7/1991 | Switzerland . |

OTHER PUBLICATIONS

Patent Abstracts of Japan, vol. 10, No. 62 (M-460) 12 Mar. 1986.

Abstract of JP 60-233414, Ikuo for "Catalyst Combustion Device" Nov. 1985.

Abstract of JP 61-291817, Yoshiyuki for "Catalyst Combustion Device" Dec. 1986.

*Primary Examiner*—Carroll B. Dority

*Attorney, Agent, or Firm*—Foley & Lardner

[57] ABSTRACT

A self-heating type catalytic combustion apparatus and method for igniting catalyst mass effectively within a short period of time and under a clean state and for realizing pleasant heating and having a long life-span of catalyst mass. The self-heating type catalytic combustion apparatus includes: a conductive self-heating type catalyst mass having electrodes for supplying power source to the catalyst mass; electrically energizing system for energizing electrically the catalyst mass; reaction gas supply member for supplying reaction gas comprising fuel and air to the catalyst mass; temperature detection circuit for detecting temperature of the catalyst mass; and control circuit by which the electrically energizing means are so controlled at the time of ignition that the catalyst mass is preheated to a predetermined temperature and the reaction gas supply member is so controlled that the reaction gas is supplied to the catalyst after a temperature detected by the temperature detection means reaches to the predetermined preheating temperature.

17 Claims, 17 Drawing Sheets

CATALYTIC COMBUSTION APPARATUS AND METHOD

BACKGROUND OF THE INVENTION

1. Field of the Invention

The present invention relates to a catalytic combustion apparatus, and it particularly relates to a catalytic combustion apparatus using a self heating type catalyst.

2. Description of the Prior Art

Catalyst combustion which is surface combustion on the catalyst differs completely in combustion process from usual vapor combustion. Thus, the catalyst combustion has many advantageous features. For instance, as a typical feature, since a catalyst temperature can be suppressed down to 1000° C. or lower, generation of thermal $NO_x$ (nitrogen oxides) can be suppressed to a great degree. Moreover, due to the surface combustion on the catalyst combustion, a combustor itself becomes a radiation unit, so that pleasant radiation heating can be realized when the combustor is employed as a room heater. Moreover, there is little concern for a flame since a combustion temperature is low. Moreover, since there is no need for a combustion chamber necessary for the conventional combustor, the combustor becomes compact-sized.

In order to perform a desirable catalytic combustion on the catalyst, it is necessary that reaction gas quantity is proper corresponding to a catalyst volume and catalyst area, and that the catalyst is kept above a temperature by which the catalyst is sufficiently active against the reaction gas. Usually, such a temperature is approximately 500° C. minimum under the combustion in combination of a precious metal catalyst such as Pt (platinum) and Pd (palladium) and a hydro carbon or the like. That is to say, sufficient reaction cannot be performed unless the temperature becomes approximately 500 ° C. or more, and if the temperature is below 500° C., produced is unburnt gas including carbon monoxides (CO) harmful to human body and unburnt hydro carbon attributable to unpleasant smell.

In the combustion apparatus such as a stove or the like, the catalyst temperature is as low as an ambient temperature at the time of ignition. Under such condition, the reaction gas is not ignited and the unburnt gas is discharged. Thus, an ignition operation is necessitated to preheat the catalyst in advance and supply the reaction gas thereafter.

Conventionally, as a general preheating method, there is available a method by which a preheating burner or a preheating heater is provided in an upstream side of catalyst mass to primarily heat the air and then feed the primarily heated air to the catalyst mass so as to preheat the catalyst mass. However, many problems are caused thereby as follows.

Namely, in both the preheating burner and the preheating heater, it is not efficient that the catalyst is preheated indirectly through the air preheated. In this case, quite a bit of volume of air besides the catalyst mass has to be heated, and the surrounding parts such as an air passage are heated concurrently and unnecessarily, thus wasting a great deal of energy and time. Moreover, temperature is distributed unevenly to the air to be heated, and the catalyst mass temperature thus becomes unevenly distributed As a result, at the time of ignition a part of the reaction gas passing through a low-temperature portion of the catalyst mass passes through as being unreacted, thus causing a problem of producing odor and white flame. Furthermore, a space for installing the preheating heater has to be provided, thus causing a problem where the apparatus becomes rather bulky and the extra cost therefor is necessary. When a kerosene burner is used as the preheating burner, further added time will be required since there will be needed a further rise time such as for preheating a carbureter of the kerosene burner itself. In that case, the preheating burner performs a vapor combustion in which $NO_x$ is naturally produced. Moreover, carbon is a catalyst poison. Even a small quantity of soot (carbon) may cause the catalyst to deteriorate when the soot is absorbed into the catalyst.

When using the preheating heater, a large-volume heater for heating the air is required. Accompanied by the large-volume heater, a large-volume relay circuit and thick lead wires and so on will be also necessitated, thus increasing otherwise unnecessary electric parts so as to cause a problem where the initial cost such as the cost for producing a finished product and the operational cost such as electricity consumption increase.

Now, in order to have a pleasant heating without an on-off switching operation in a combustion apparatus such as a stove, it is required to have wide range of heating capacity to vary. It is to be noted that catalyst temperature varies according to the heating capacity, that is, combustion quantity.

FIG. 1 shows a typical performance characteristic of the conventional catalytic combustion apparatus. The catalyst temperature rises as the quantity of reaction gas increases up to temperature T2 where the reaction gas is flashed back to the air-fuel mixture (reaction gas) in the upstream side. The catalyst temperature declines as the quantity of reaction gas decreases to temperature T1 where a CO density of the unburnt gas goes over the allowable value. Both T1 and T2 indicate the limit of combustion. Namely, quantity G1 at temperature T1 is the lower limit of combustion quantity whereas G2 at T2 the upper limit. Under normal circumstances, the ratio of quantity G1 of reaction gas over quantity G2 of reaction gas is said to be 1:3 maximum.

FIG. 2 shows a relation between the heating capacity and the catalyst temperature. Heating capacity Q1, Q2 corresponding to reaction gas quantity G1, G2 respectively are the lower limit and upper limit of the heating capacity, respectively. The variable range of heating capacity is 1:3 maximum. Recently, the heat insulating capacity in regular houses has been significantly improved. In this connection, it is not necessary to have a large-scale heating capacity once the temperature reaches the set-up temperature. For this reason, not the conventional ratio of 1:3 as the heating capacity variable range but something of 1:10 is required in order to achieve pleasant heating without an on-off switching operation. In the conventional catalytic combustion apparatus, the on-off switching operation is of course needed, but this on-off switching operation causes unpleasantness due to the change of room temperature accompanied by the on-off switching. Moreover, the on-off switching operation consumes otherwise unnecessary electricity, thus creating a problem in view of conservation of energy. Moreover, there is a problem concerning heat shock which damages material as a result of an extreme change in temperature in the course of thermal expansion. This problem occurs very frequently because the catalyst temperature varies corresponding to the heating capacity. The on-off switching operation accelerates the damage degree of heat shock so as to shorten the life-span of the catalyst itself.

Distinguished from the conventional combustor employing vapor reaction, the catalytic temperature becomes very high by the catalytic surface reaction in the catalytic combustion apparatus utilizing a contact catalytic reaction. Thus, when used for a long period of time, the catalyst becomes deteriorated. Sintering is the typical symptom to indicate the deterioration of catalyst. Sintering is such that active ingredients such as Pt and Pd which are evenly distributed as small particles on the catalyst mass are combined and thus the surface area of the active ingredients can not be secured, so that the reaction activity of the catalyst as a whole deteriorates. Another symptom is that the reaction activity of the catalyst deteriorates when the active ingredients evaporate. When the reaction activity of the catalyst deteriorates, the catalyst temperature declines since sufficient reaction does not occur. When the catalyst temperature declines, the reaction activity of the catalyst is further suppressed thus causing a vicious circle. In this case where the deteriorated catalyst is used, the unburnt gas is mixed into the catalyst mass so as to cause a problem where odor is produced, the heat efficiency is decreased and a poisonous gas is generated. Moreover, in other cases, a problem of catalyst vibration phenomenon may occur that the catalyst temperature vibrates and fluctuates severely. Thus, when such a catalytic combustion apparatus is applied to a heating apparatus, it must be considered to provide catalyst deterioration detecting means. In the conventional practice, there is considered a function by which the density of poisonous gas is detected, for example, by an unburnt gas detecting sensor such as a density detecting sensor of CO. Moreover, there is considered a function by which the catalyst temperature is detected in a manner that the catalyst temperature drops below the predetermined temperature calculated on the basis of a functional relation between the catalyst temperature and the reaction gas quantity to define deterioration of the catalyst so that the combustion operation is terminated. However, in this case, the deterioration of the catalyst is detected and the combustion operation is terminated only after the poisonous gas is already produced and the catalyst temperature is already dropped, so that the generation of unburnt gas is already in existence.

As a conventional method to start the catalytic combustion, there is available a method in which the air is preheated by the preheating burner or heater provided in the upstream side of catalyst mass and then the preheated air is supplied to the catalyst mass so as to preheat the catalyst mass. However, the method has following drawbacks.

The catalyst is indirectly preheated by heating the air as heating medium, thus causing a great deal of energy loss and consuming much time. Furthermore, unevenness of temperature in the preheated air causes non-uniform temperature distribution in the catalyst mass, thus causing odor and white flame accompanied along with the unburnt gas generated at the time of ignition. Moreover, there is a disadvantage in which the apparatus is of rather bulky size and requires an extra cost for providing a space for the preheating burner or heater.

When a kerosene burner is used as the preheating burner, a rise time for the preheating burner itself, such as the preheating time for the carbureter is additionally required. Moreover, the preheating burner performs vapor combustion which is of course accompanied by occurrence of $NO_x$. The carbon is a kind of catalyst poison. Therefore, even a small quantity of the carbon (soot) may deteriorate performance of catalyst, when the soot is absorbed to the catalyst.

Since a sufficient variable range for capacity in the conventional catalytic combustion apparatus is not provided, the on-off operation takes place to cause unpleasantness, unnecessary combustion, and deterioration of the life span of catalyst due to the heat shock.

Furthermore, in the conventional practice, the deterioration of the catalyst is detected and the combustion operation is terminated only after the poisonous gas is already produced and the catalyst temperature is already dropped, so that the generation of unburnt gas is already in existence by the time that the deterioration of catalyst is detected, thus causing odor, deterioration of heat efficiency, generation of poisonous gas, and temperature fluctuation of the catalyst.

SUMMARY OF THE INVENTION

It is therefore an object of the present invention to provide a catalytic combustion apparatus capable of igniting a catalyst mass effectively in a short time and under a clean state and capable of realizing pleasant heating and having a long life span of the catalyst mass.

It is another object of the present invention to provide a method to realize the above catalytic combustion apparatus.

According to one aspect of the present invention, there is provided a catalytic combustion apparatus comprising: a conductive self-heating type catalyst mass (referred to as a catalyst mass hereinafter) including electrodes for supplying power source to the catalyst mass; electrically energizing means for energizing electrically the catalyst mass; reaction gas supply means for supplying a reaction gas comprising fuel and air to the catalyst mass; temperature detection means for detecting temperature of the catalyst mass;and control means by which the electrically energizing means are so controlled at the time of ignition that the catalyst mass is preheated to a predetermined temperature and the reaction gas supply means is so controlled that the reaction gas is supplied to the catalyst after a temperature detected by the temperature detection means reaches the predetermined preheating temperature.

According to another aspect of the present invention, there is provided a method of catalytic combustion, comprising the steps of: electrically energizing the catalyst mass; supplying a reaction gas comprising a mixture of fuel and air to the catalyst mass; detecting a temperature of the catalyst mass; igniting the catalyst mass and reaction gas; controlling the level of the electrical energizing; judging whether the catalyst mass is ignited after the reaction gas is supplied; switching off the electrical energization when ignited, or shutting off supply of the reaction gas when not ignited; and re-igniting the catalyst mass at a newly predetermined temperature which is higher than the previous predetermined catalyst activation temperature after purging unburnt reaction gas, when the catalyst reaction gas is not ignited.

Other features and advantages of the present invention will become apparent from the following description taken in conjunction with the accompanying drawings.

BRIEF DESCRIPTION OF THE DRAWINGS

In the accompanying drawings:

FIG. 14(*b*) shows an enlarged view of a portion of FIG. 14(*a*).

DETAILED DESCRIPTION OF THE PREFERRED EMBODIMENTS

Embodiments according to the present invention will be described in detail with reference to the accompanied drawings. The embodiments employed herewith according to the present invention are applied to a kerosene stove.

FIGS. 3 through 8 show the first embodiment.

Figure 3:
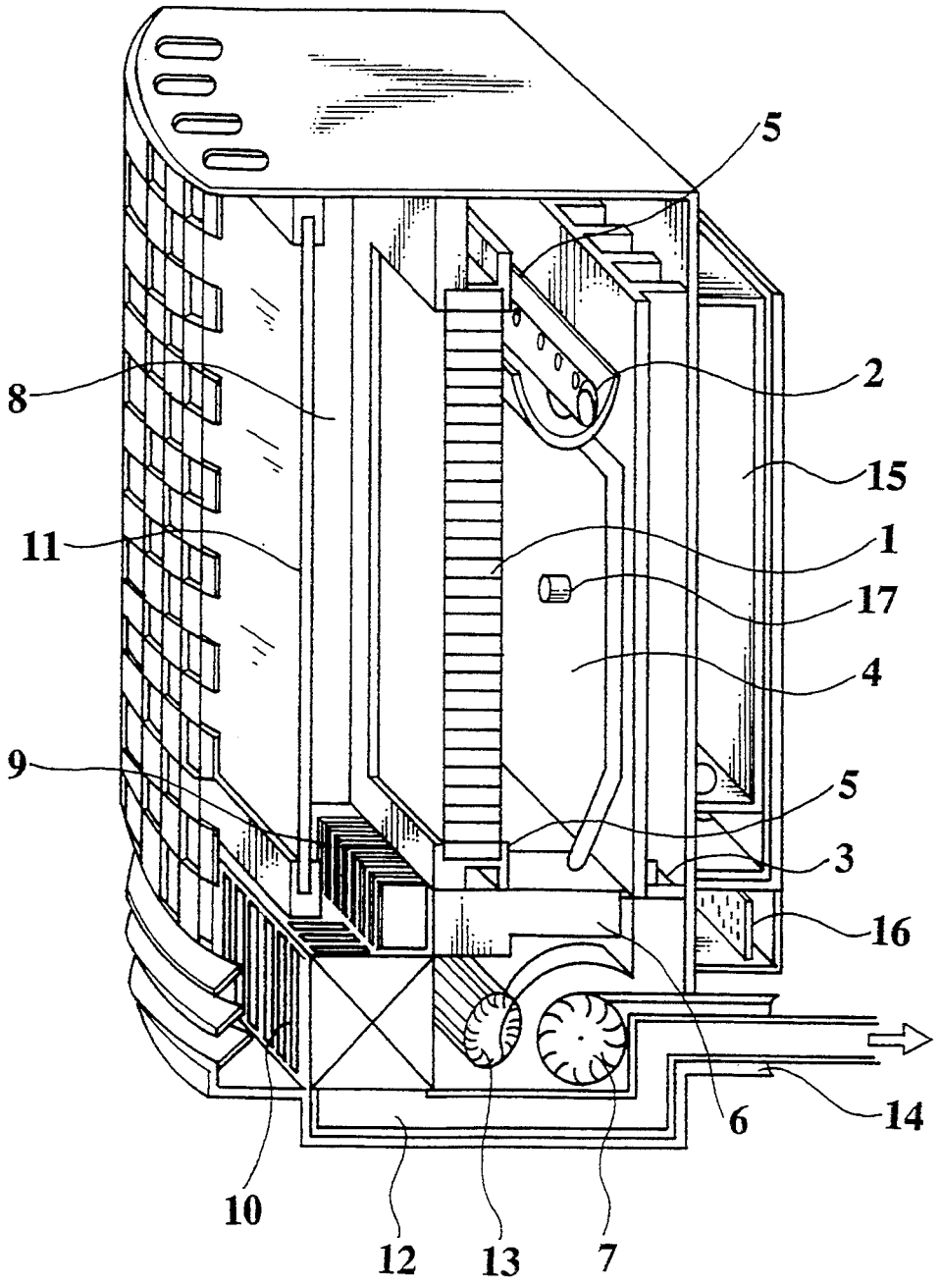
FIG. 3 shows an inside configuration of a catalytic stove employed as a catalytic combustion apparatus according to the first embodiment of the present invention.

Overall configuration of a catalytic combustion apparatus will be described with reference to FIG. 3. The reference numeral 1 denotes a self-heating type catalyst mass (referred to as a catalyst mass hereinafter). The reference numeral 2 denotes a vapor blowout pipe by which vaporized Fuel of kerosene is mixed into combustion air. The reference numeral 3 denotes a gate through which the combustion-air is supplied. The reference numeral 4 denotes a reaction gas supply duct which supplies to the catalyst mass 1 the reaction gas that is a mixture gas of kerosene vapor and combustion air. The vapor blowout pipe 2 and the reaction gas supply duct 4, etc. constitute means for supplying the reaction gas. The reference numeral 5 denotes an electrode serving as means for electrically energizing and heating the catalyst mass 1. The kerosene vapor is supplied through a carburetor 6. The combustion air is supplied by an air supply fan 7 from outside of a room through a suction pipe 14. The reference numeral 8 is an exhaust pipe through which the combustion gas reacted in the catalyst mass 1 flows. The reference numeral 9 denotes a heat recovery exchange for recovering heat of the combustion gas to the carburetor 6. The reference numeral 10 denotes a heat exchange by which the heat not recovered by tile heat recovery exchange 9 is carried to the inside of the room by a convection Fan to heat the air. The reference numeral 12 is an exhaust pipe through which the combustion gas that is heat-exchanged flows. A temperature sensor 17 serving to detect the temperature of catalyst mass 1 is provided in the upstream side of the catalyst mass 1. The temperature sensor 17 is of a non-contact type, that is, the temperature sensor 17 has no direct contact with the catalyst mass 1. The temperature sensor 17 detects infrared from the catalyst mass 1 so as to measure the temperature of catalyst mass 1. The kerosene is stored in a kerosene tank 15. The reference numeral 16 denotes a control circuit board which serves as means for controlling each part belonging to the kerosene stove. The reference numeral 11 is a heat resistance glass window which is provided to give effective radiation heating where the radiation heat from the catalyst mass 1 is permeated into the room air.

Figure 4:
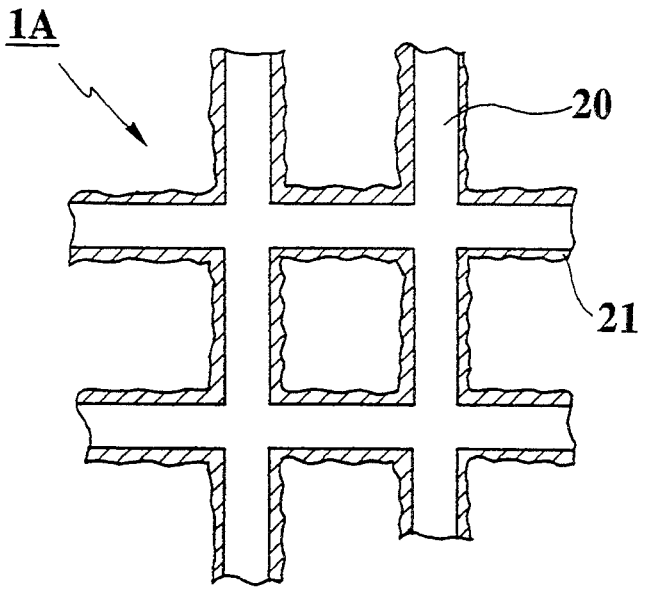
FIG. 4 shows an exploded cross-sectional view of an example of a self-heating type catalyst mass (referred to as catalyst mass hereinafter) according to the first embodiment of FIG. 3.

FIG. 4 shows an example of cross sectional view in which the catalyst mass 1A is constructed using a honeycomb support. In the same figure, the reference numeral 20 denotes a conductive catalyst support and the reference numeral 21 a catalyst coating layer. As the catalyst support 20, there can be used conductive ceramic such as silicon carbide (SiC), ceramic primarily composed of SiC, titanium boride ($TiB_2$), or ceramic primarily composed of $TiB_2$. Moreover, as the catalyst support 20, metal composed of such material as ferritic stainless steel can be used.

Figure 5:
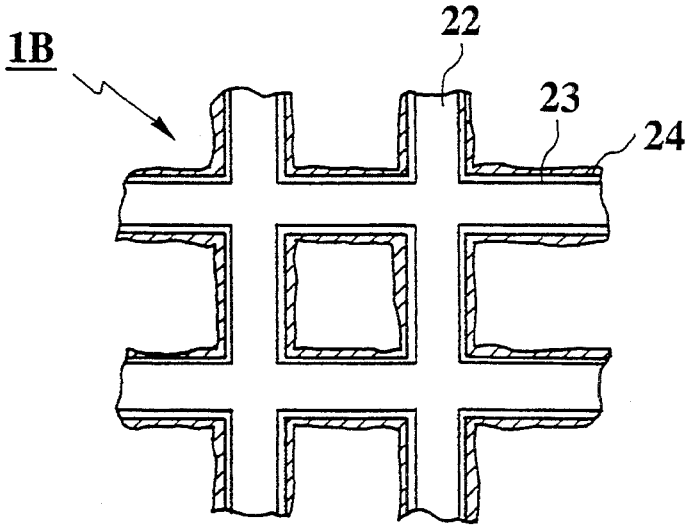
FIG. 5 shows an exploded cross-sectional view of another example of the self-heating type catalyst mass according to the first embodiment of FIG. 3.

FIG. 5 shows another example to construct the catalyst mass 1. In the same figure, the reference numeral 22 is a non-conductive catalyst support on the surface of which conductive ceramic 23 is coated. A catalyst coating layer 24 is coated on the surface of the conductive ceramic 23. In general, the conductive ceramic is costly. However, by constructing the catalyst mass as shown in 1B, the ceramic can be freely chosen that is less costly and has sufficient heat resistance as the catalyst support 22. Moreover, it shall be appreciated that the shape of catalyst mass 1 is not limited to the honeycomb support but may be of any porous ceramic such as corrugated type and foaming type, etc.

Figure 6:
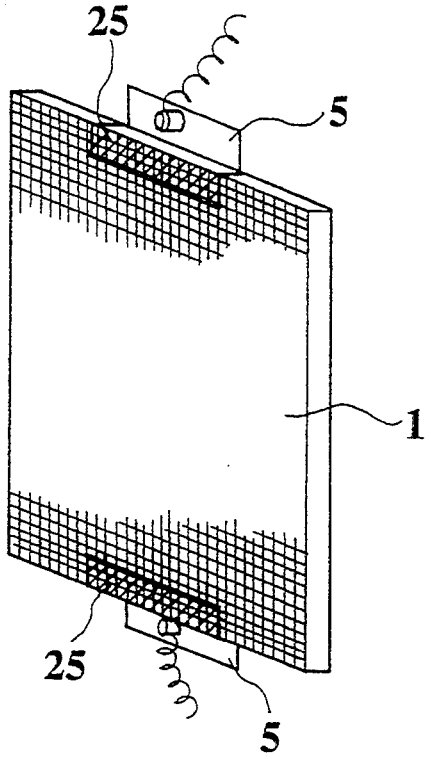
FIG. 6 shows a perspective view of electrodes being mounted to the catalyst mass of the first embodiment.
Figure 7:
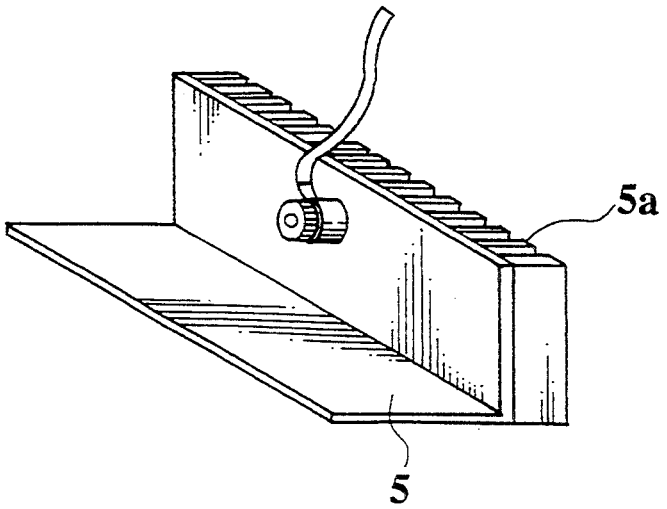
FIG. 7 shows a perspective view of electrodes having radiation fin implemented to the catalyst mass of the first embodiment.

FIG. 6 shows how to mount electrodes 5, through which the catalyst mass 1 is electrically energized, to the catalyst mass 1. The two electrodes are disposed counter to each other as shown in FIG. 6 so that the current flows evenly through the catalyst mass 1. In general, the electrodes 5 are made of copper plates which are not as heat-resistant as the ceramic is, thus may be melted in an extreme case when the catalytic combustion takes place to produce a high temperature around the electrodes 5. To avoid such possible melting of the electrodes, there is provided an area 25 around the electrodes in which no catalyst is coated so that the electrodes cannot be overheated. Namely, there will be no reaction taking place in the area 25 on which no catalyst is coated, so that the electrodes 5 are not exposed to the high temperature that may have the copper-made electrodes melted. FIG. 7 shows a further advanced effective way to avoid such an overheat problem of the electrodes by providing a radiation fin **5*a* with the electrodes 5**.

Figure 25:
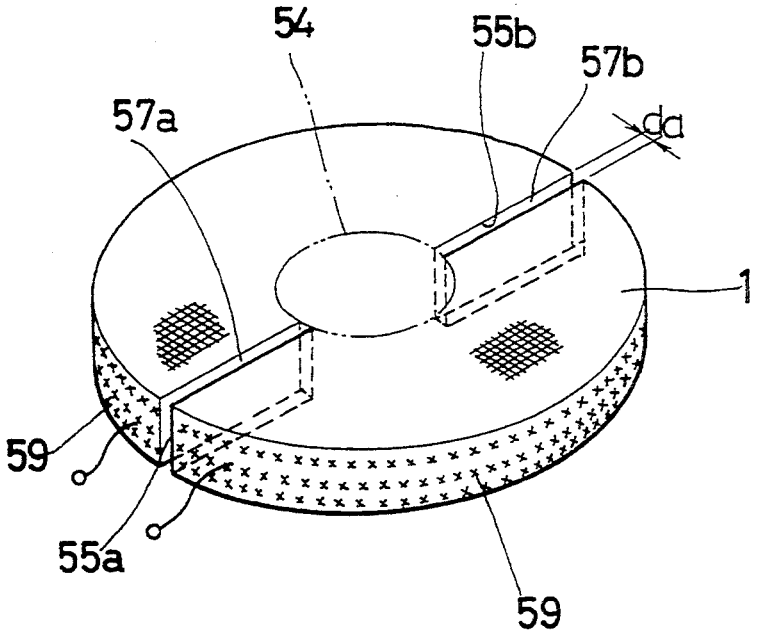
FIG. 25 shows another example of catalyst mass 1 where a cross section orthogonal to the reaction-gas flow direction is a disc shape.

FIG. 25 shows another example of the catalyst mass where a cross section orthogonal to the reaction-gas flow direction is a disc shape. There are provided notch portions **55*a*, 55*b* extended radially from two points on peripheral portion of the catalyst mass 1 toward a central portion 54. Air gaps 57*a*, 57*b* formed by the the notch portions 55*a*, 55*b* serve as electrically insulating means. Accordingly, the catalyst mass 1 is divided in two portions excluding the central portion 54. Each peripheral portion divided is applied with silver paste or the like, thus serving as a pair of electrodes 59, 59**.

Figure 26:
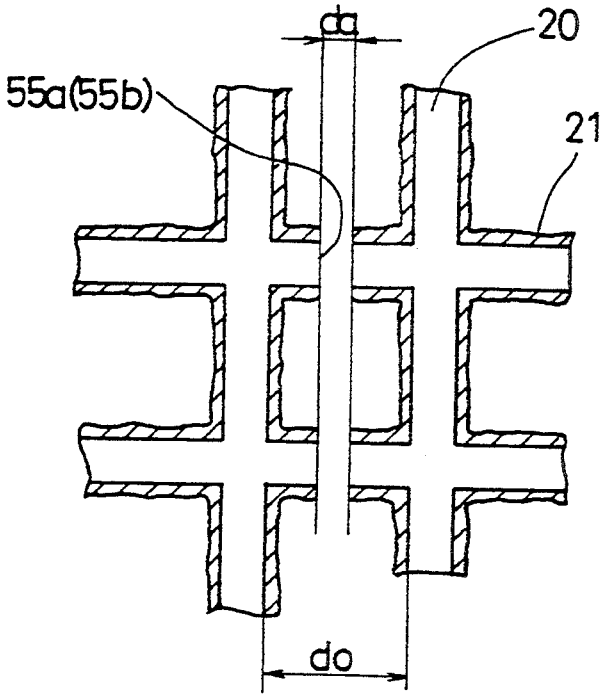
FIG. 26 and FIG. 27 show enlarged view of the notch portion 55*a* (55*b*) of the catalyst mass i shown in FIG. 25.
Figure 27:
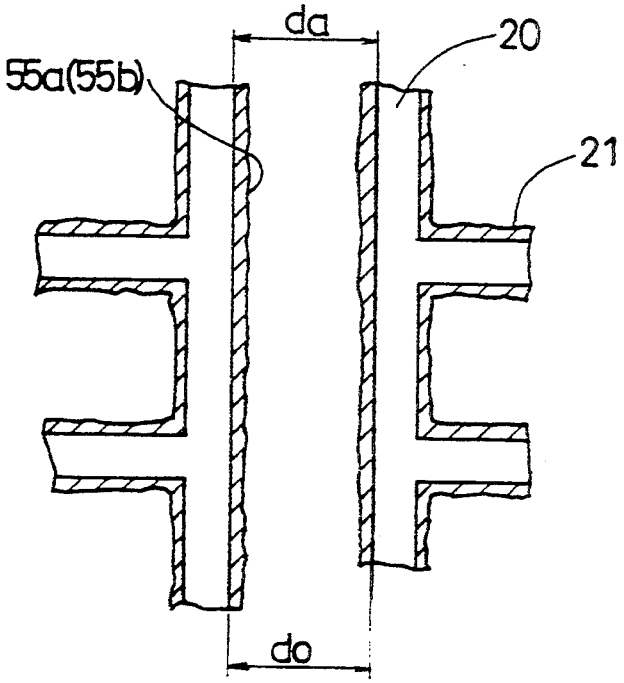

FIG. 26 and FIG. 27 show enlarged view of the notch portion **55*a* (55*b*) of the catalyst mass 1. Width da of the notch portion 55*a* (55*b*) and width do of a space between adjacent unit cells of the catalyst mass 1** are such that $$da \leqq d_o.$$

In other words, a row of the space divided by the unit cells is eliminated radially except for the central portion 54. It is to be noted that a plurality of rows may be eliminated, that is to say, $da < d_o$. FIG. 27 shows a catalyst mass of FIG. 25 where $da = d_o$. However, in view of the optimal combustibility, $da \leqq d_o$ is most suitable.

Figure 28:
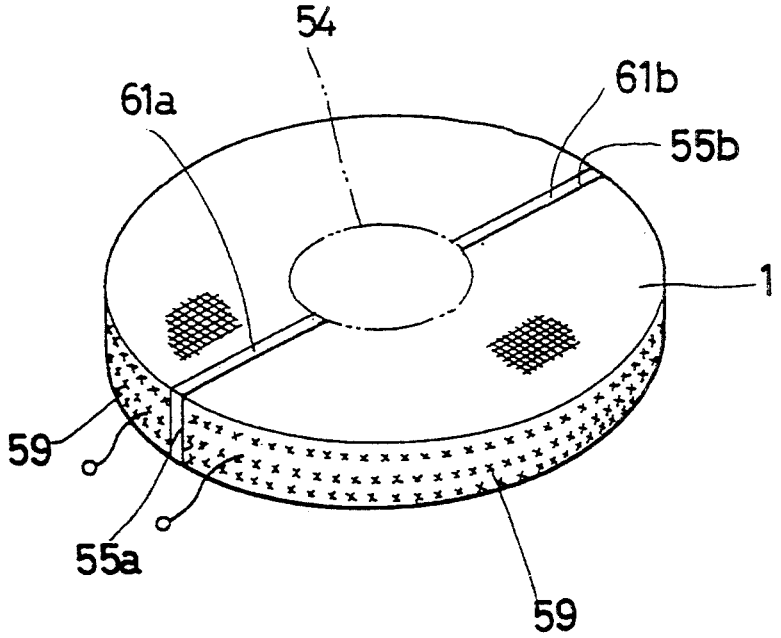
FIG. 28 shows the catalyst mass 1 of FIG. 25 where air gaps 57*a*, 57*b* (FIG. 25) are filled with heat-resistant insulating members 61*a*, 61*b*.
Figure 29:
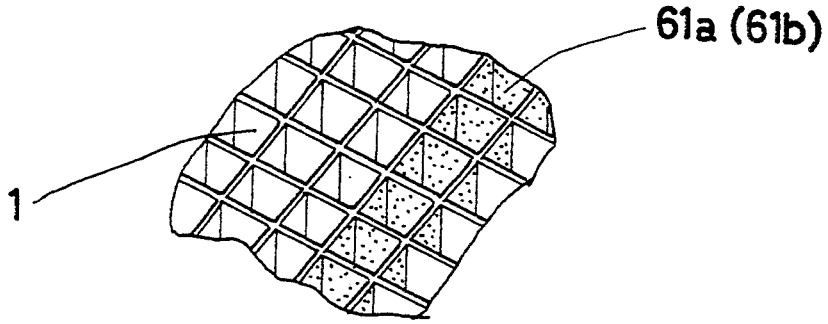
FIG. 29 shows the catalyst mass 1 of FIG. 28 where the insulating members 61*a*, 61*b* are integrated into the catalyst mass 1.

The reference numerals **61*a*, 61*b* in FIG. 28 show heat-resistant insulating members filling the air gaps 57*a*, 57*b* (electrically insulating means) in FIG. 25. The insulating members 57*a*, 57*b* can be filled after the notch portions 55*a*, 55*b* are formed. The insulating members may be integrated with the catalyst mass 1 as shown in FIG. 29**.

Figure 30:
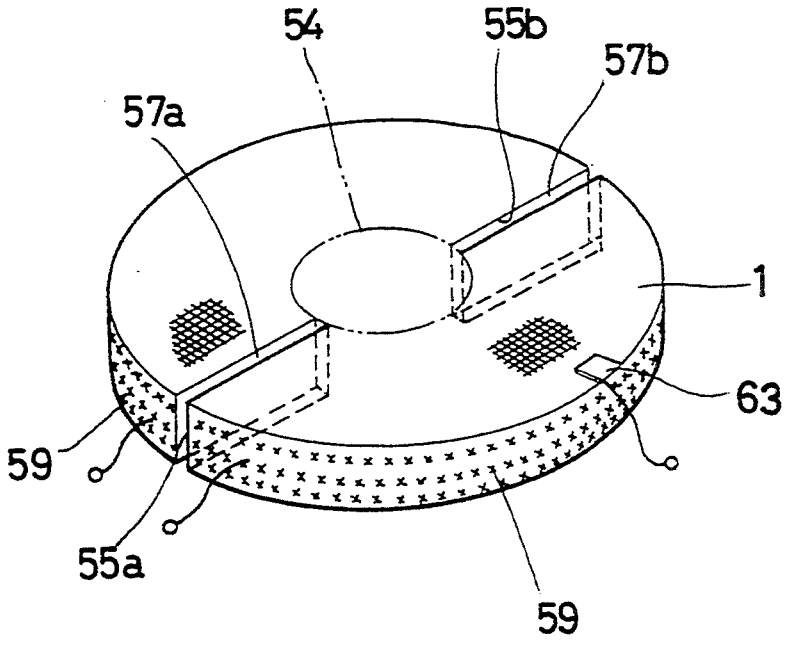
FIG. 30 shows the catalyst mass 1 equipped with a temperature sensor 63.

The catalyst mass 1 being thus constructed, heat generation is started at the current-concentrated central portion 54 when the catalyst mass 1 is electrically energized, and a high temperature area radiates toward a peripheral portion of the catalyst mass 1, thus minimizing radiation loss and realizing uniform temperature distribution over the catalyst mass 1 in the peripheral direction. When the reaction gas is supplied to the catalyst mass 1 which thus has been preheated, the catalyst is reacted and the heat is generated. An electrode 59 is not exposed to the reaction surface during the catalytic reaction, so that reliability of the electrode 59 is improved. A temperature sensor 63 may be installed in the neighborhood of the peripheral portion as shown in FIG. 30 so that timing for supplying the reaction gas can be easily detected, thus eliminating odor, white flame and so on. FIG. 26 and FIG. 27 show an example of a cross sectional view in which the catalyst mass 1 is constructed using a conductive honeycomb support 20 on which a catalyst coating layer is formed, as in FIG. 4. The catalyst mass 1 may be constructed using a non-conductive catalyst support on the surface of which is coated the conductive ceramic on which the catalyst coating layer is further coated, as shown in FIG. 5.

Figure 8:
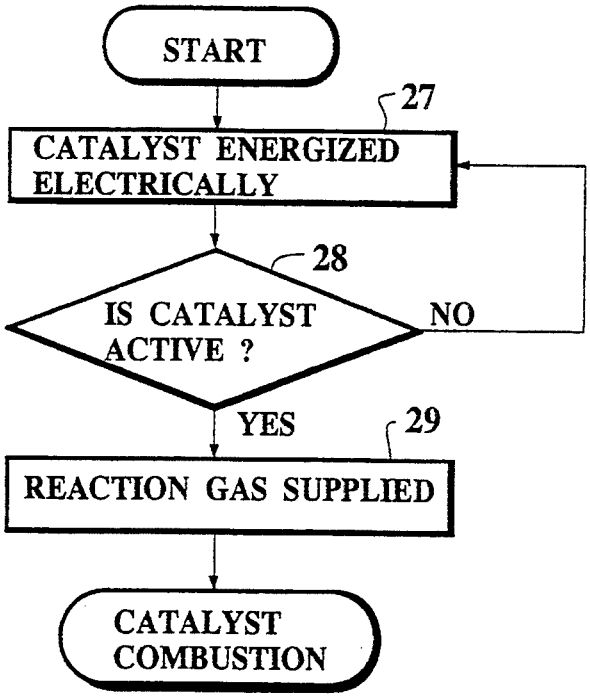
FIG. 8 is a flowchart showing an example of ignition sequence in the first embodiment.

FIG. 8 shows an ignition sequence of the catalyst combustion apparatus constructed as above. The catalyst mass 1 is electrically energized so that the catalyst mass 1 is preheated (step 27), before the reaction gas is supplied at a start. Then, after the catalyst mass 1 becomes sufficiently active against the reaction gas (step 28), the reaction gas is supplied so as to complete the ignition operation (step 29).

By preheating the catalyst mass 1 as stated above, there will be no need to preheat the air as a heat medium as conventionally carried out, and therefore there will be no concurrent and unnecessary heating of the surrounding parts thereof such as an air passage and other ducts, thus the catalyst mass 1 is preheated efficiently in a short time. Moreover, since there will be no need to provide a space for parts such as a preheating burner or preheating heater within the combustion apparatus, thus making the apparatus compact-sized as a whole. Moreover, since the current flows almost uniformly through the catalyst mass 1 and the catalyst mass 1 is evenly heated, the unburnt exhaust produced at ignition is significantly reduced. When the conventional preheating burner is used, there are generated $NO_x$ and soot. In with the present invention there is no concern over such a problem and the life-span of the catalyst mass 1 is greatly improved for there is no catalyst poison generated.

FIGS. 9 through 12 show the second embodiment of the present invention which differs from the first embodiment in a controlling procedure at the time of ignition.

Figure 9:
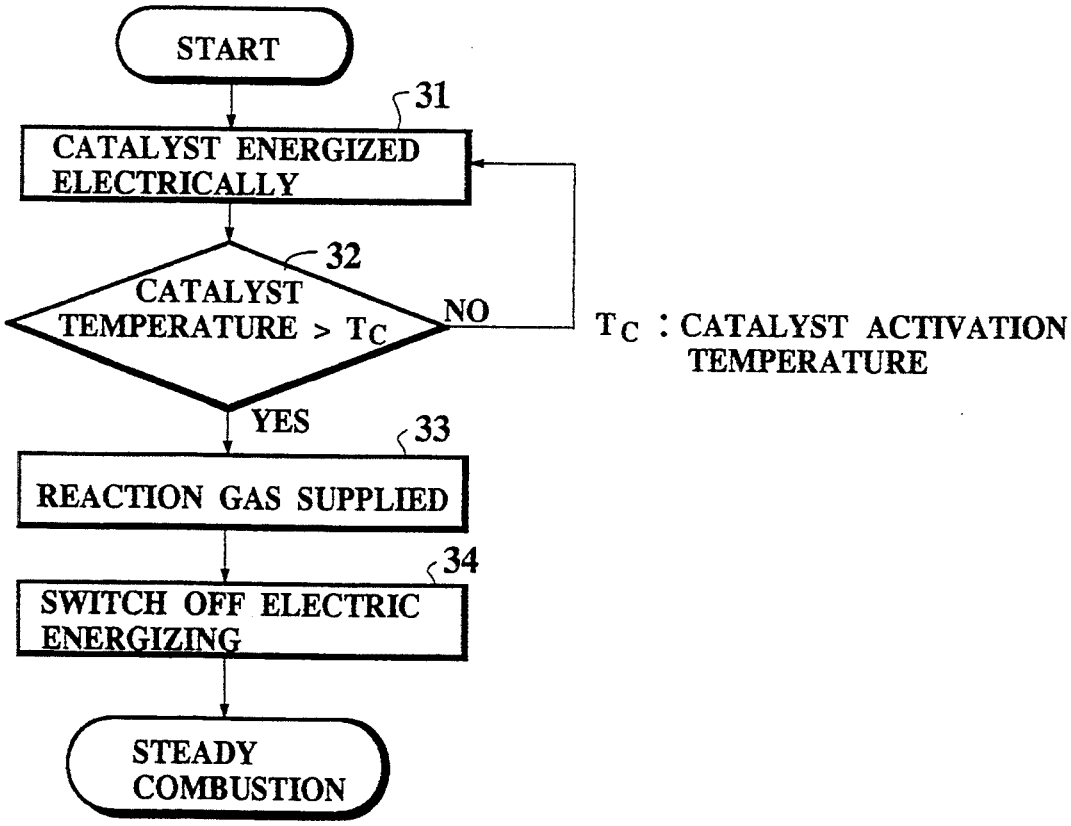
FIG. 9 is a flowchart showing an example of ignition sequence in the second embodiment of the present invention.

FIG. 9 shows the first example of ignition sequence in the second embodiment. The catalyst mass 1 is preheated by being electrically energized before the reaction gas is supplied to the catalyst mass 1 at start (step 31). Then, when the temperature of the catalyst mass 1 becomes sufficiently active against the reaction gas, namely, temperature Tc or over, the reaction gas is supplied so as to complete the ignition operation (step 32, 33). In general, an active temperature Tc of the catalyst mass 1 is known to be 300° C. or greater. Once the catalyst mass 1 is ignited, it is heated by the reaction. There may not be a need for electrically energizing the catalyst mass 1 thereafter (step 34). Carrying out the preheating of the catalyst mass 1 as stated before, there will be no need to preheat the air as a heat medium as conventionally carried out, and therefore there will be no concurrent and unnecessary heating of the surrounding parts thereof such as an air passage and other ducts, thus the catalyst mass 1 is preheated efficiently in a short time. Moreover, the unburnt exhaust can be minimized and there is no catalyst poison generated, so that the life-span of the catalyst is significantly improved.

Figure 10:
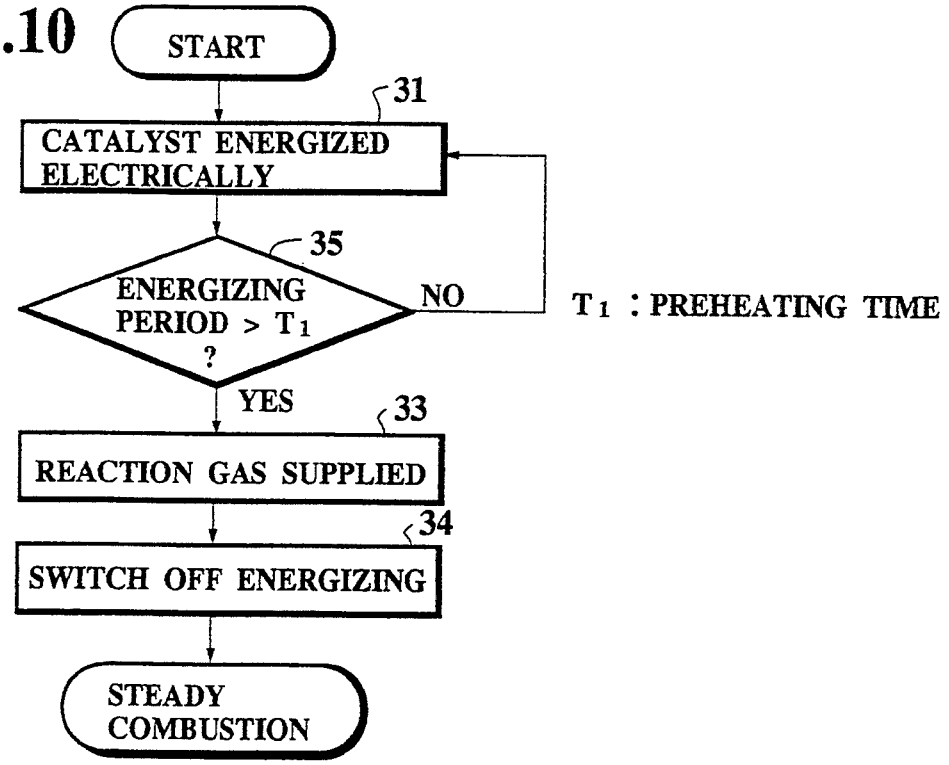
FIG. 10 is a flowchart showing another example of ignition sequence in the second embodiment.

FIG. 10 shows the second example of ignition sequence according to the second embodiment. In this second example, the catalyst mass 1 is preheated for a predetermined duration of time, instead of detecting the temperature of the catalyst mass 1 (step 35). The heat capacity for the catalyst mass 1 is almost constant, so that the preheating time T1 for heating the catalyst mass 1 is also constant, thus simplifying the preheating control scheme.

Figure 11:
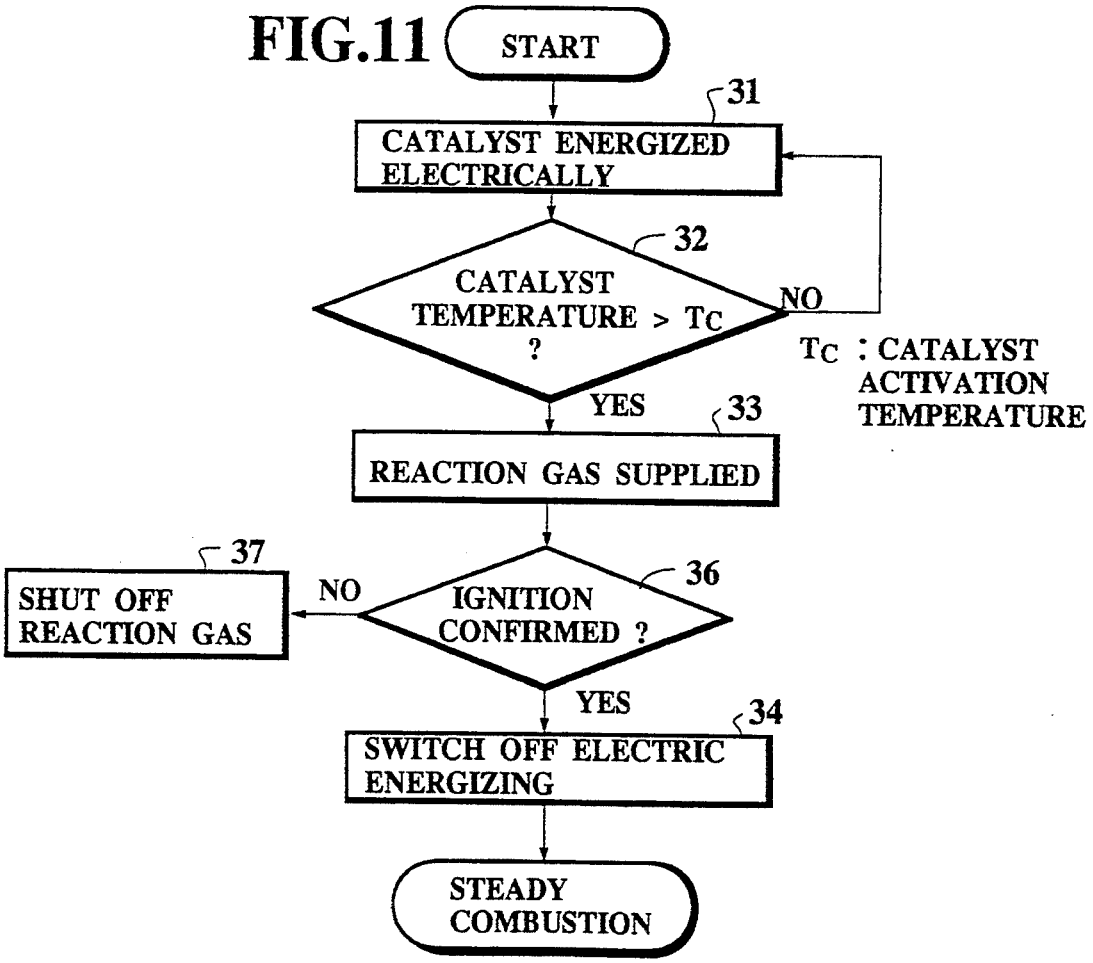
FIG. 11 is a flowchart showing still another example of ignition sequence in the second embodiment.

FIG. 11 shows the third example of ignition sequence according to the second embodiment. In this third example, it is determined whether the catalyst mass 1 is ignited or not after the reaction gas is supplied (step 36). If safely ignited, electrically energizing the catalyst mass 1 is switched off (step 34); if not, supply of the reaction gas is controlled to be stopped (step 37). When ignited, there is no need for electrically energizing the catalyst mass 1, thus consuming otherwise unnecessary electricity is avoided.

Figure 12:
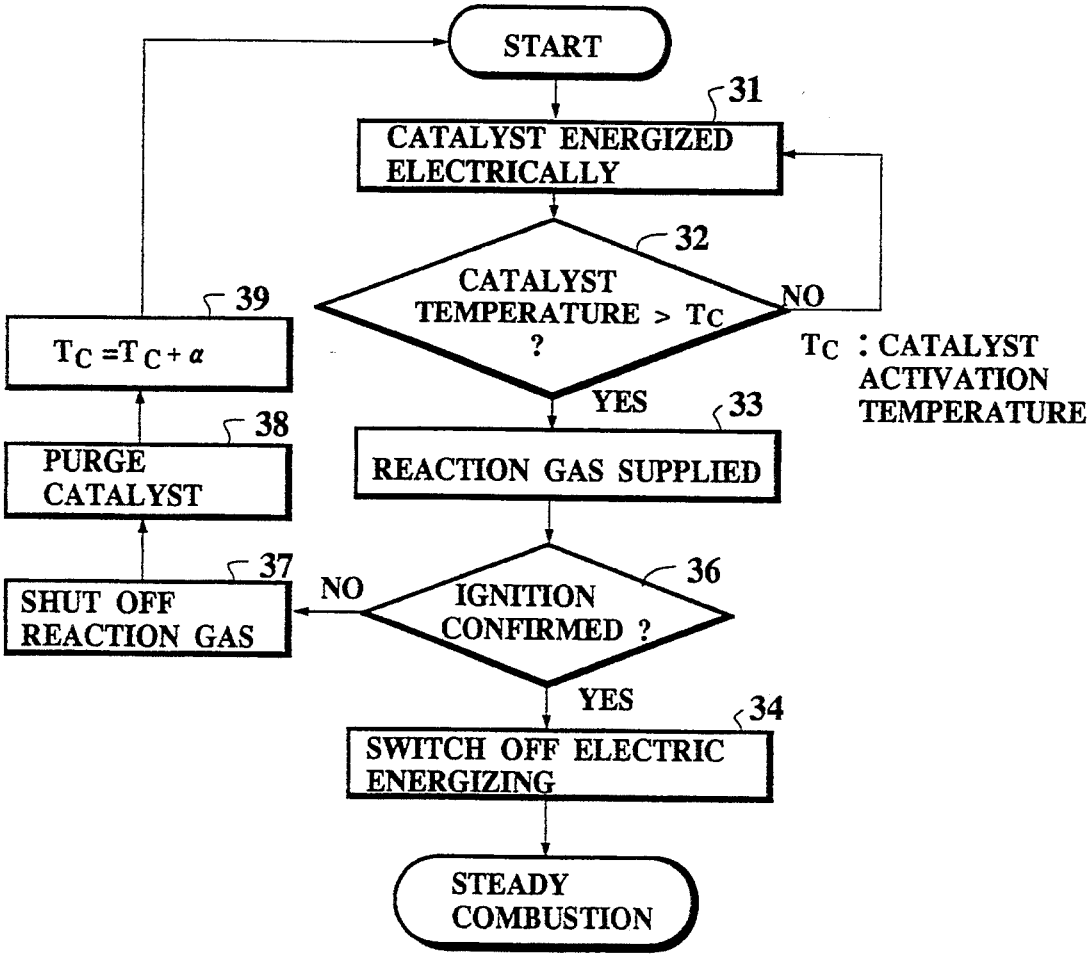
FIG. 12 is a flowchart showing a further example of ignition sequence in the second embodiment.

FIG. 12 shows the fourth example of ignition sequence according to the second embodiment. In this fourth example, a re-ignition method for the catalyst mass 1 is shown when the catalyst mass 1 is not ignited. After the ignition confirmation is carried out after the reaction gas is supplied (step 36), the reaction gas is shut off when found not ignited (step 37). Then, after the unburnt gas left over is purged out (step 38), a re-ignition mode is performed (START). In the course of stepping up to the re-ignition mode, a new catalyst active temperature is defined in such a manner that the new catalyst active temperature is set by adding a few temperatures thereon, say plus $\alpha$, on the basis of the predetermined catalyst active temperature, and then the re-ignition mode is operated (step 39). The plus $\alpha$ is in the neighborhood of 20° C. in usual cases. By setting the newly defined catalyst active temperature accordingly, the ignition is carried out with ease even when the catalyst mass 1 has been deteriorated to cause a high possibility of ignition failure due to the long-time usage. Now, considering a case where the catalyst mass 1 has deteriorated enough to be unable to continue to have normal reaction, an upper limit for the catalyst active temperature is set in order to check such an extreme condition. Under normal circumstances, such upper limit is in some neighborhood of 500° C.

FIGS. 13 through 17 show the third embodiment according to the present invention.

First, an example of construction in temperature detecting means is described.

Figure 13:
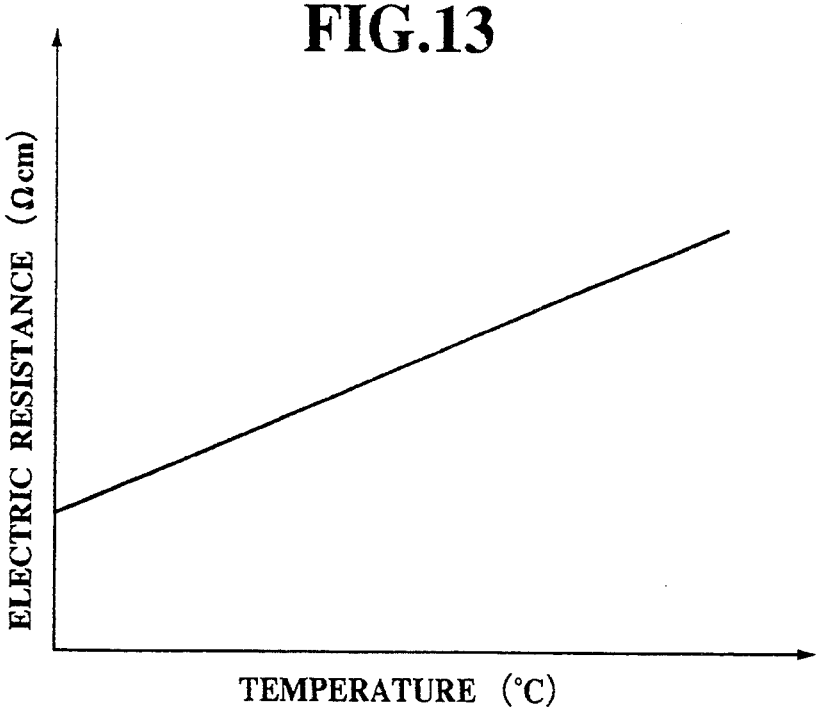
FIG. 13 shows correlation between conductivity and catalyst temperature of the catalyst mass so as to detect the temperature of catalyst mass in the third embodiment of the present invention.

FIG. 13 shows a relation between an electric resistance and a temperature, to thereby realize resistance value type temperature detecting means by which the temperature of catalyst mass 1 is obtained. Under normal circumstances, the electric resistance is functionally related to the temperature, and its characteristics vary with a type of the catalyst mass 1 used. The same figure shows a typical case of the catalyst mass 1 where the electric resistance increases as the temperature increases. Accordingly, the temperature of catalyst mass 1 is indirectly obtained by knowing the electric resistance value.

Figure 14:
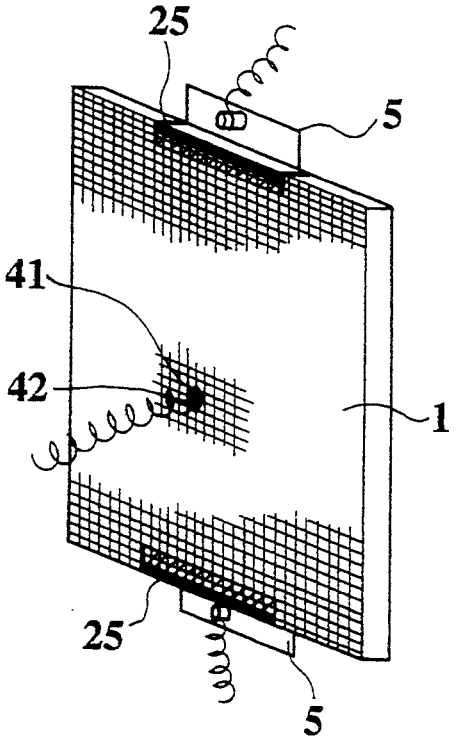
FIG. 14(*a*) shows a perspective view of a contact-type temperature sensor being mounted to the catalyst mass of the third embodiment.
Figure 14:
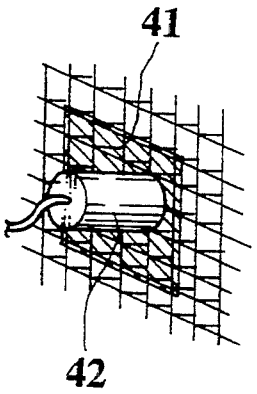

FIG. 14(*a*) shows an example of a contact-type temperature detecting means in which a temperature sensor is attached to the catalyst mass 1. FIG. 14(*b*) shows an exploded view of the area thereof where the temperature sensor is attached to the catalyst mass 1. The reference numeral 1 is the catalyst mass 1. The reference numeral 5 denotes a pair of electrodes for electrically energizing the catalyst mass 1. The is reference numeral 25 indicates an area of the catalyst mass 1 where no catalyst is coated thereon. The reference numeral 41 is a non-conductive portion. The reference numeral 42 denotes a contact-type temperature sensor provided in the non-conductive portion. Since no electric current flows through the non-conductive portion when the catalyst mass 1 is electrically energized, even the contact-type temperature sensor can measure the temperature of catalyst mass 1.

Figure 15:
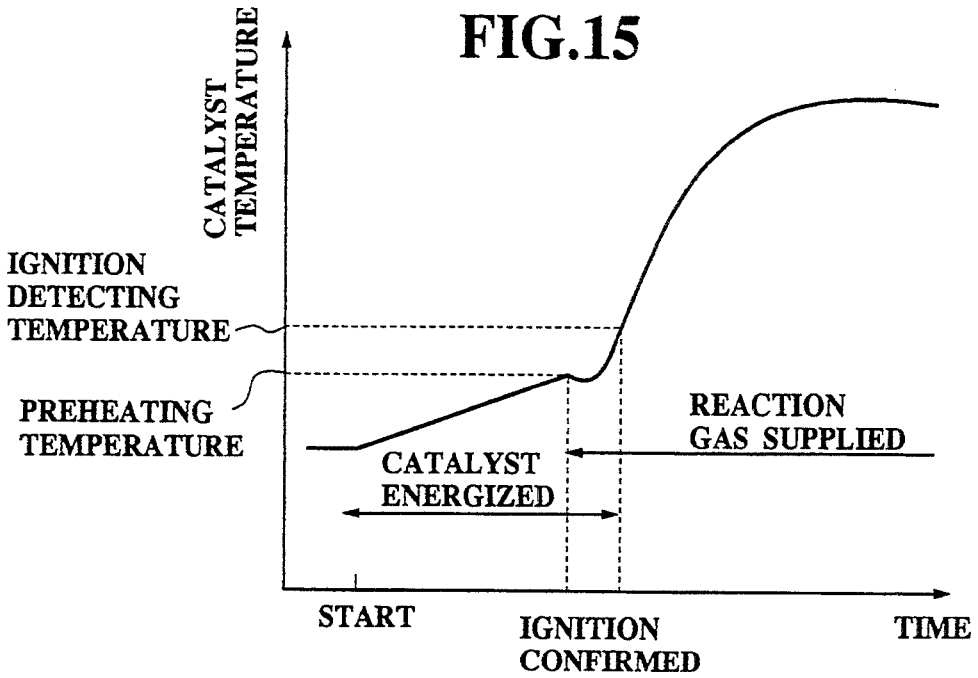
FIG. 15 shows an example of ignition confirmation in the third embodiment.
Figure 16:
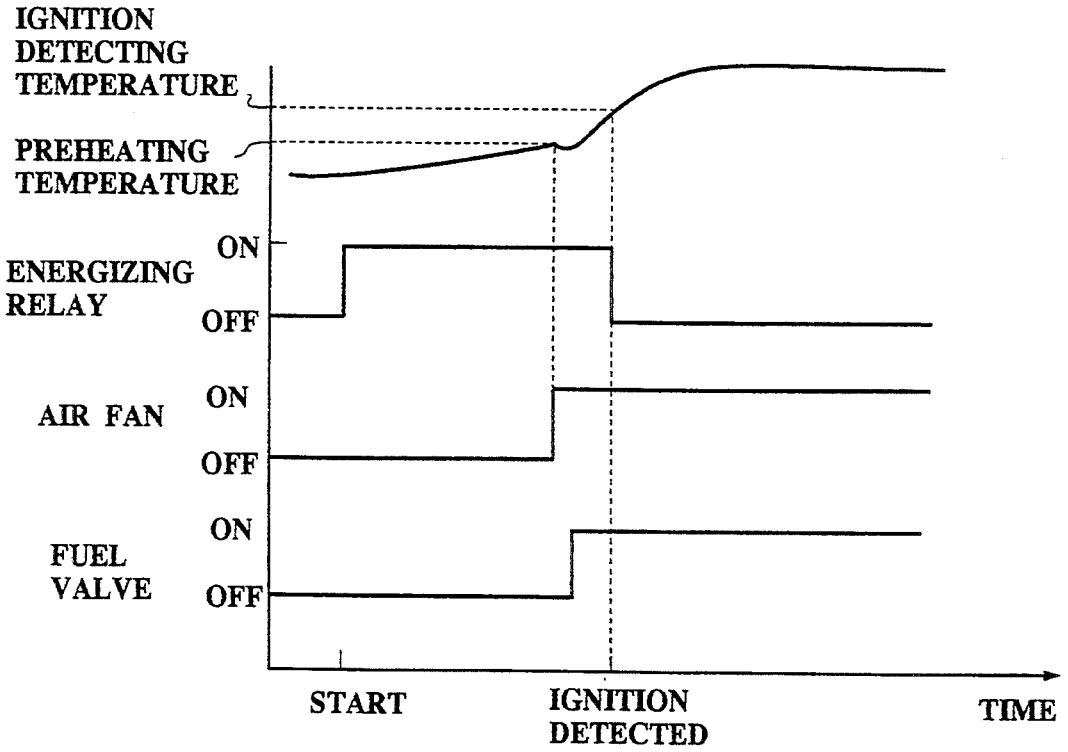
FIG. 16 is a timing chart of respective valves, relay and so on in the third embodiment.

FIG. 15 shows the first example of an ignition determining operation according to the control means of the catalyst combustion apparatus. When the temperature of catalyst mass 1 becomes higher than a predetermined preheating temperature of catalyst mass 1 electrically energized, the heating by the reaction is detected and the the catalyst mass 1 is judged to be ignited. The same figure shows how the temperature of catalyst mass 1 changes as time lapses at the time of ignition. When the catalyst mass 1 is first electrically energized, the temperature thereof increases up to the predetermined preheating temperature. Then the reaction gas is supplied. Then, the temperature of catalyst mass 1 declines slightly for a short while until the reaction gas is fully activated. Right after the reaction gas starts to be fully activated, the temperature increases rapidly. Observing the above-mentioned process, an ignition determining temperature is set at a higher temperature than the preheating temperature. Thus, the catalyst mass 1 is judged to be ignited when the temperature of catalyst mass 1 becomes or is greater than the predetermined ignition determining temperature. FIG. 16 shows a timing chart of an electric energizing relay, air supply fan 7 and fuel valve at the time of ignition. At START, the catalyst mass 1 is electrically energized. Then the air supply fan 7 starts operating when the temperature of catalyst mass 1 reaches the preheating temperature, pre-purging through the combustion apparatus. Thereafter, the fuel valve is opened to supply the fuel.

Figure 17:
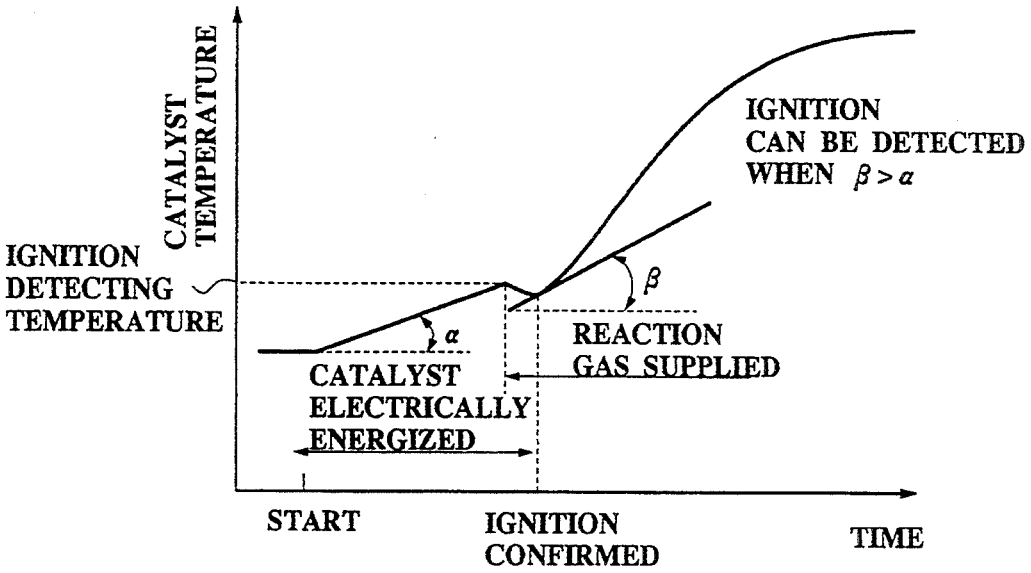
FIG. 17 shows another example of ignition confirmation in the third embodiment.

FIG. 17 shows the second example of an ignition determining operation according to control means of the catalyst combustion apparatus. In this ignition determining operation, the ignition operation is determined in such a manner that the reaction is judged to be safely started or not according to a temperature gradient of the catalyst mass 1. Let $\alpha$ be the temperature gradient at the time when the temperature of catalyst mass 1 begins to rise after the catalyst mass 1 is electrically energized at start. Let $\beta$ be the temperature gradient at the time when the reaction gas is supplied after the catalyst mass 1 reaches the preheating temperature. The catalyst mass 1 continues to be electrically energized until the catalyst mass 1 is judged to be ignited. Therefore, temperature gradient $\beta$ of the catalyst mass 1 is greater than temperature gradient $\alpha$ of the catalyst mass 1 for, as shown in the FIG. 17, there are temperature rises due to both electrical energizing and the reaction itself. Now, the following formula is defined as a standard for ignition determination. When such a condition is satisfied, the catalyst mass 1 is judged to be ignited.

$$\beta > \alpha$$

Figure 18:
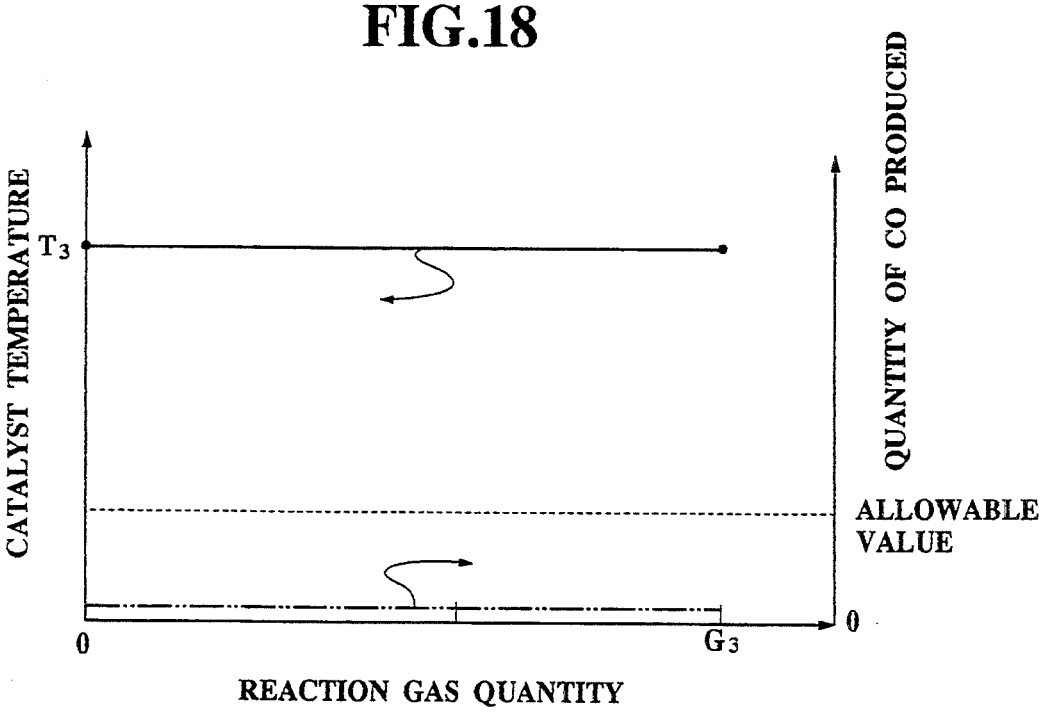
FIG. 18 shows correlation between the reaction gas quantity, the catalyst temperature and the quantity of CO produced according to the fourth embodiment of the present invention.
Figure 19:
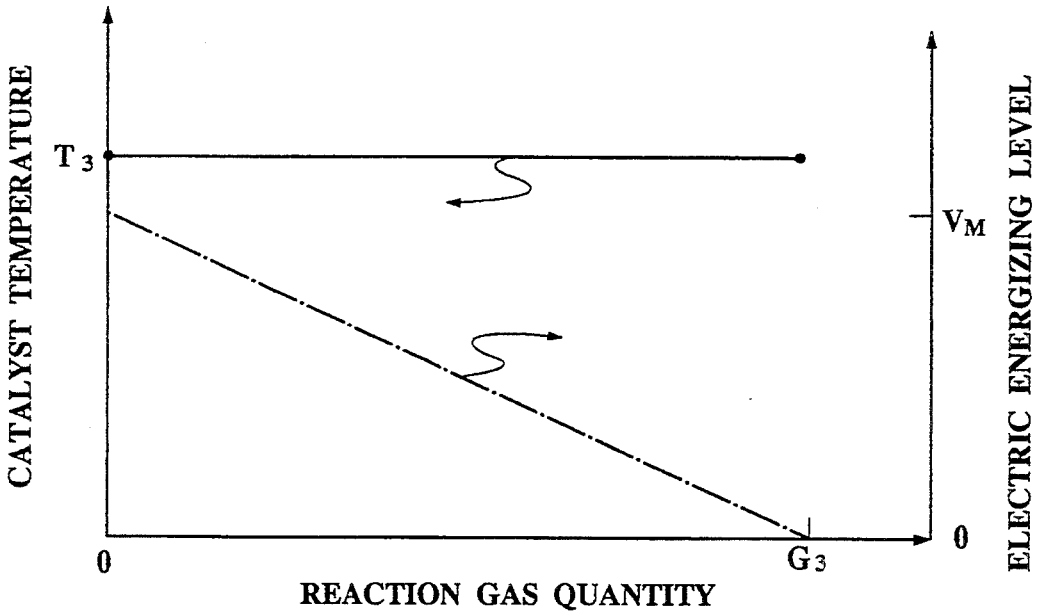
FIG. 19 shows correlation between the reaction gas quantity, the catalyst temperature and the electric energizing level of the catalyst mass in the fourth embodiment.
Figure 20:
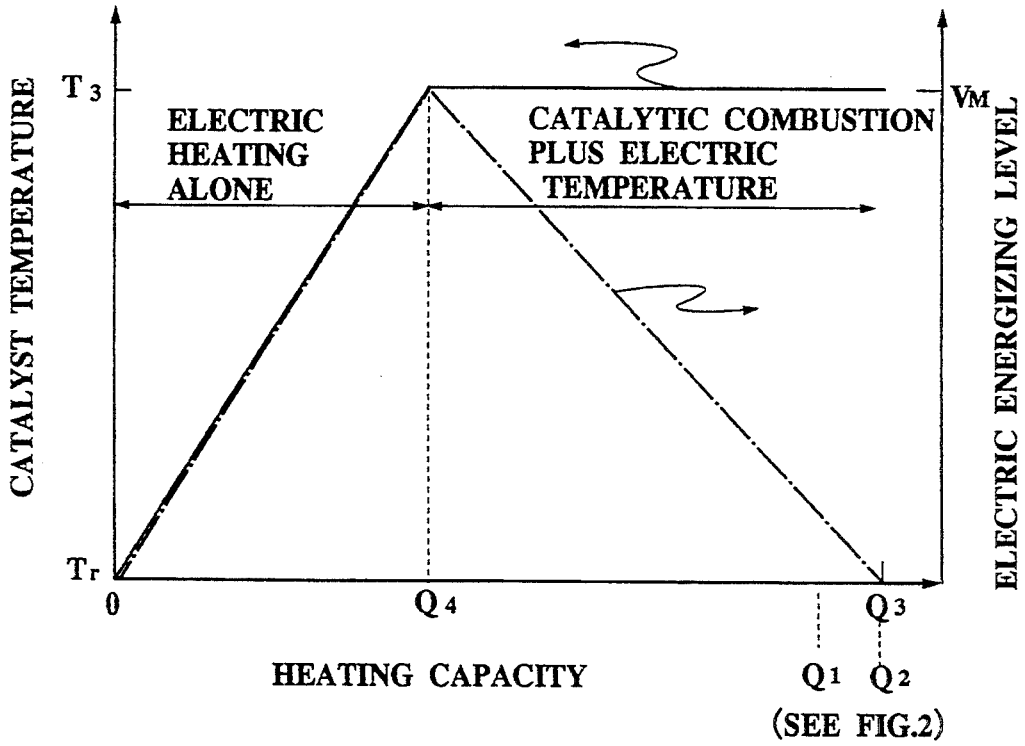
FIG. 20 shows correlation of the catalyst temperature and electric energizing level of the catalyst mass against the heating capacity in the fourth embodiment.

FIGS. 18 through 20 show the fourth embodiment according to the present invention. There is shown therein control means which controls the temperature of catalyst mass 1 at a constant value whereby the electric energizing level of the catalyst mass 1 is properly controlled regardless of the reaction gas quantity.

FIG. 18 shows a relation between the reaction gas quantity of the catalyst combustion apparatus, the temperature of catalyst mass 1 and the quantity of GO produced. In the same figure, the solid line indicates the temperature of catalyst mass 1, the dotted line indicates an allowable value of the quantity of CO produced, and the two-point dotted line indicates the quantity of CO produced. As shown in FIG. 18, in the catalytic combustion apparatus, the temperature of catalyst mass 1 is kept constant suitable for the reaction, regardless of the reaction gas quantity. Consequently, the exhaust quantity of CO is reduced significantly, and a variable range can be made as large as possible so that the reaction gas quantity can be extended to zero. When the reaction gas quantity becomes zero, that means that electric heating alone is operated. Now, temperature $T_3$ in the FIG. 18 indicates a temperature just prior to a flash back.

FIG. 19 shows a correlation between the reaction gas quantity, the temperature of catalyst mass 1 and the electric energizing level. In the same figure, the solid line indicates the temperature of catalyst mass i while the dotted line indicates the electric energizing level. In order to keep constant the temperature of catalyst mass 1, the electric energizing level is increased when the reaction gas quantity is small, whereas the electric energizing level is decreased when the reaction gas quantity is great. In reality, the electric energizing level becomes zero at maximum reaction gas quantity G3, and the electric energizing level takes the maximum value VM when the reaction gas quantity is zero.

FIG. 20 shows a relation between heating capacity, the temperature of catalyst mass 1 and the electric energizing level. In the same figure, the solid line indicates the temperature of catalyst mass 1 while the one-point broken line indicates the electric energizing level. The heating capacity range Q4 through Q3 is the domain representing the catalytic combustion, and the temperature of catalyst mass 1 is kept constant at temperature T3 by controlling the electric energizing level. As have stated already, the electric energizing level is so controlled that it diminishes as the reaction gas quantity, i.e., combustion quantity (heating capacity) increases.

Figure 1:
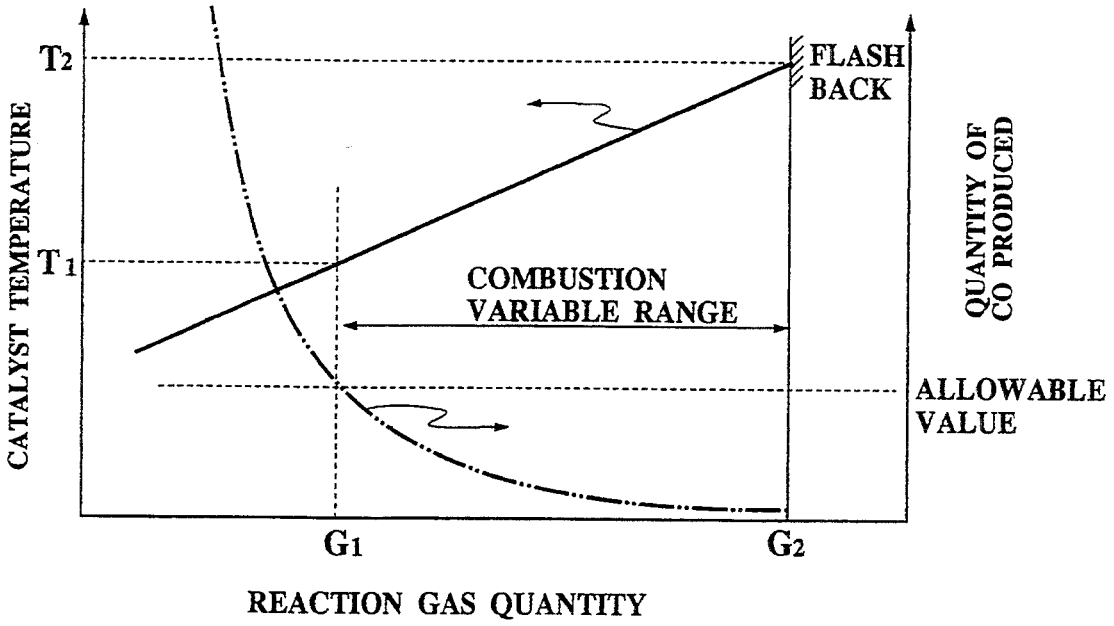
FIG.1 PRIOR ART
FIG. 1 shows correlation between reaction gas quantity, catalyst temperature and quantity of CO produced, in a conventional catalytic stove.
Figure 2:
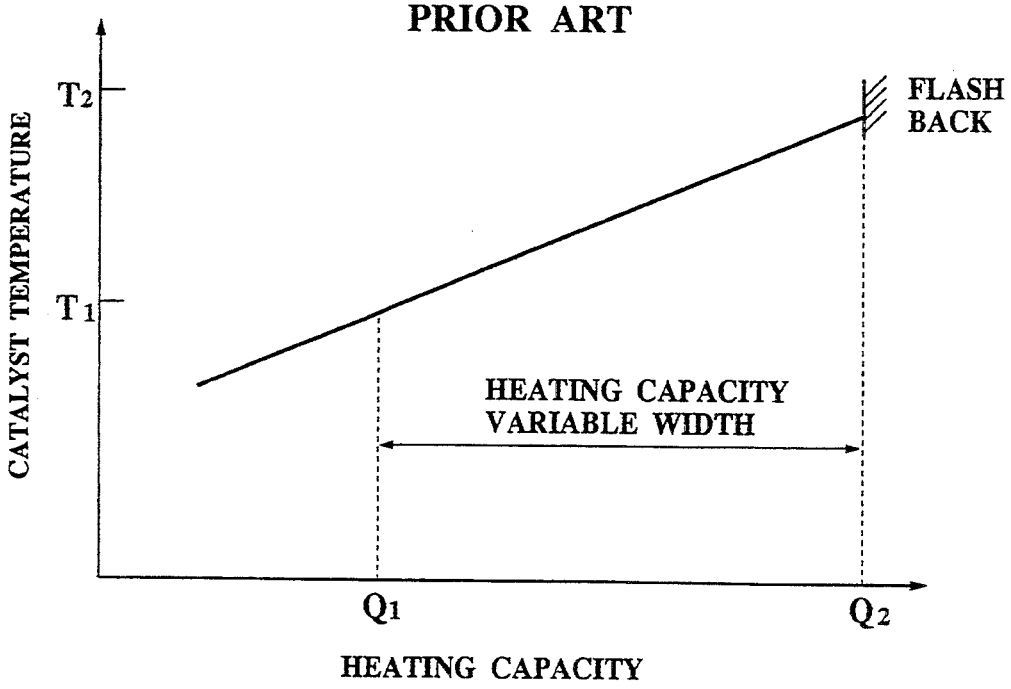
FIG.2 PRIOR ART
FIG. 2 shows correlation between heating capacity and the catalyst temperature in the conventional catalytic stove.

FIGS. 21 through 24 show the fifth embodiment of the present invention. In this fifth embodiment, temperature decline due to the deterioration of the catalyst mass to a certain degree is prevented by controlling the electric energizing level toward the catalyst mass 1. It is to be noted that the corresponding range Q1–Q2 shown in the prior art is such that the range Q1–Q2 covers a mere small portion of the range Q4–Q3 as illustrated in FIG. 20; please also see FIG. 2 in this connection.

Figure 21:
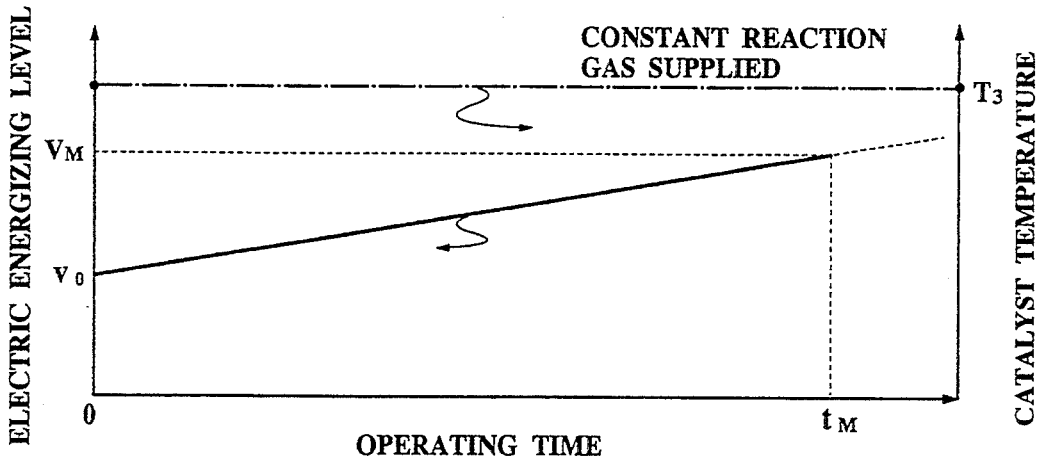
FIG. 21 shows correlation of the electric energizing level and catalyst temperature against operating time with the reaction gas being supplied at a constant rate, in the fifth embodiment of the present invention.

FIG. 21 shows a correlation between the operating time of catalytic combustion apparatus, time duration for electrically energizing the catalyst mass 1, and the temperature of catalyst mass 1, under a circumstance where the reaction gas is supplied at a constant quantity. In the same figure, there is shown that the electric energizing level increases as the catalyst mass 1 deteriorates so that the temperature of catalyst mass 1 can remain constant. Here, VM indicates a threshold value by which the deterioration of catalyst mass 1 is judged. Namely, when the electric energizing level toward the catalyst mass 1 exceeds VM, it is determined that the catalyst mass 1 is deteriorated In other words, detecting the electric energizing level can lead to detecting how badly the catalyst has been deteriorated.

Figure 22:
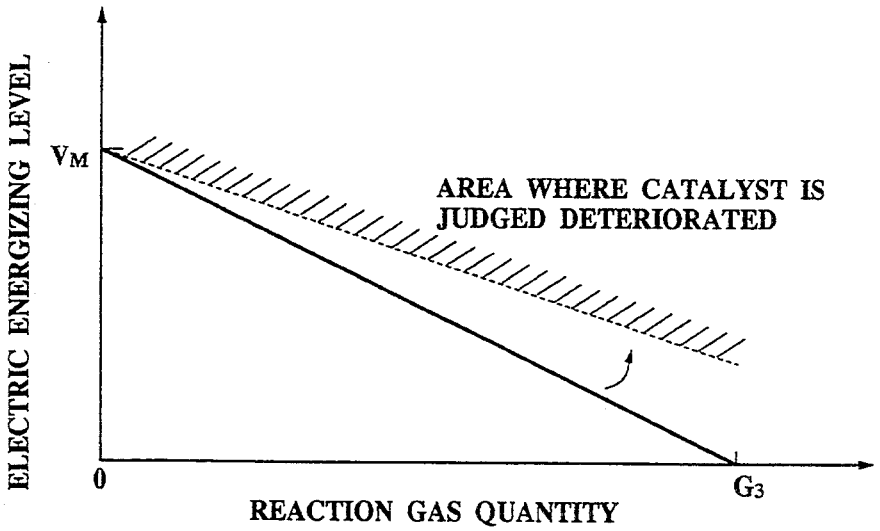
FIG. 22 shows correlation of the electric energizing level against the reaction gas quantity as the reaction gas quantity varies, in the fifth embodiment.

FIG. 22 shows the electric energizing level against the reaction gas quantity. In the same figure, the solid line indicates a state where the catalyst mass 1 is new, in other words, not deteriorated, while the dotted line shows a threshold line by which the deterioration of catalyst mass is detected. G3 is the maximum value of reaction gas supplied, indicating that the electric energizing level is zero with the catalyst mass being new. As the operating time lapses, the electric energizing level increases, and when reached to the dotted line the catalyst mass 1 is detected as thoroughly deteriorated. Namely, when the catalyst mass 1 is detected as thoroughly deteriorated, the combustion apparatus is designed to be stopped automatically.

Figure 23:
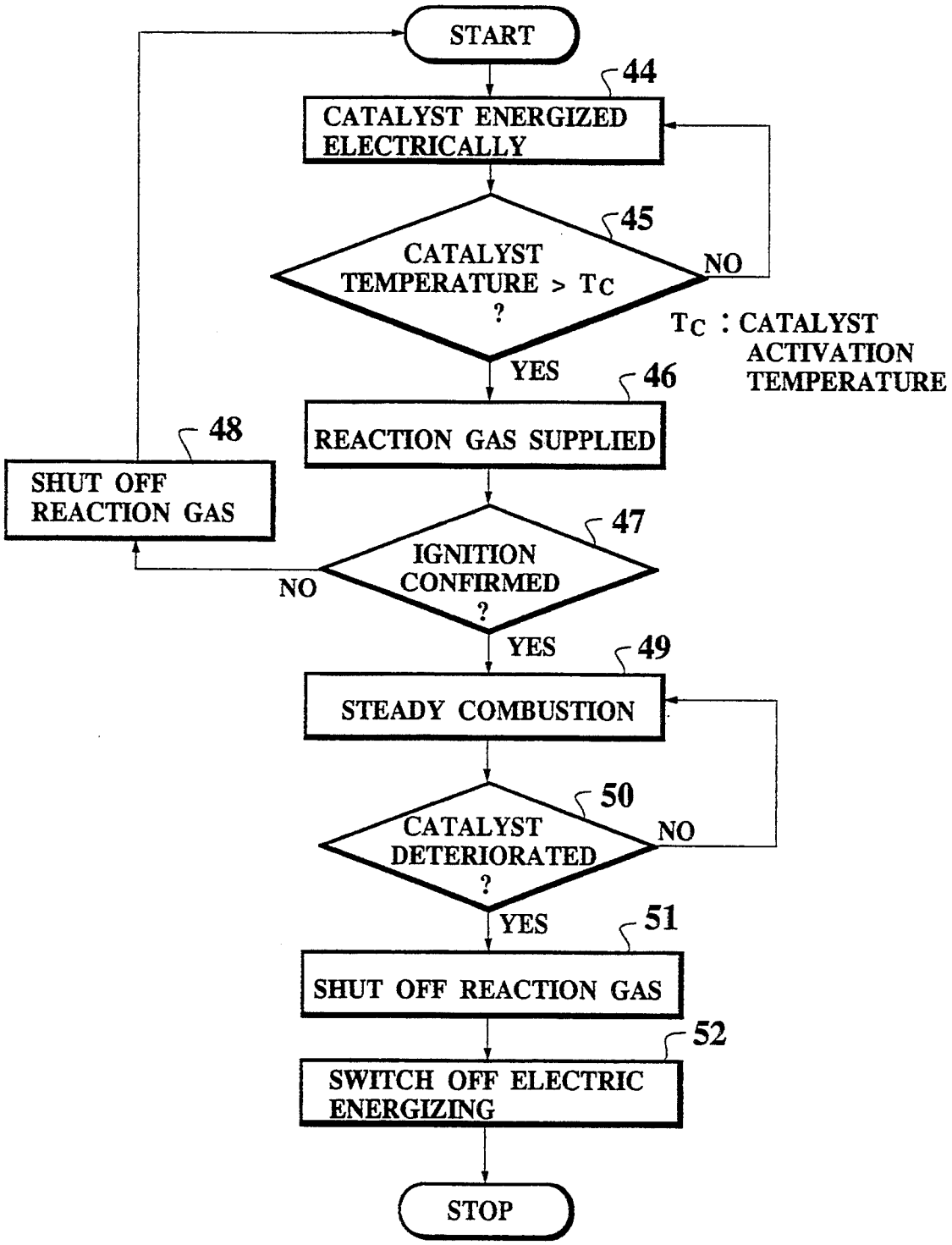
FIG. 23 is a flowchart showing a control method having a built-in function by which deterioration of the catalyst mass is detected, in the fifth embodiment.
Figure 24:
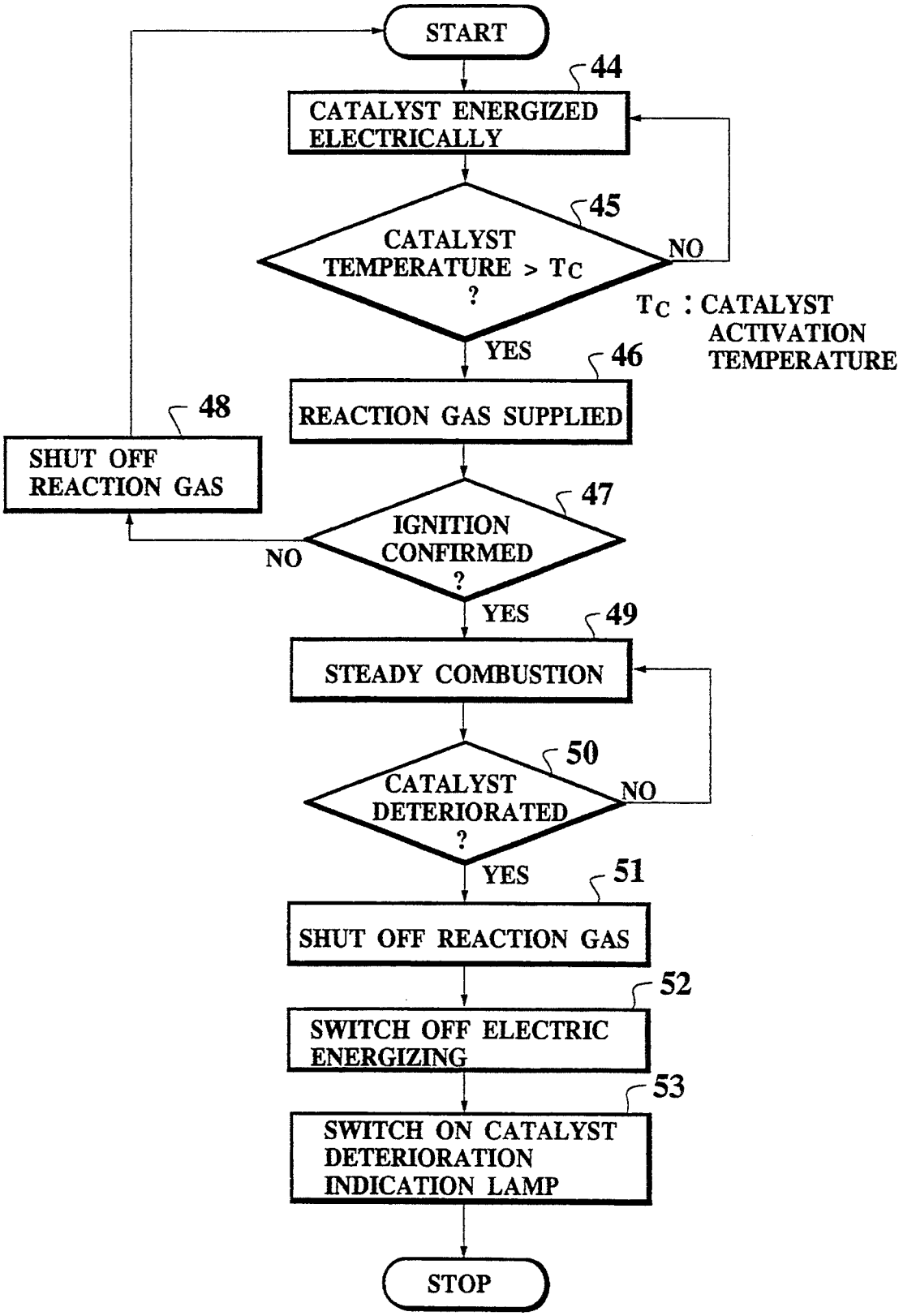
FIG. 24 is a flowchart showing a control method having a built-in monitor which serves to indicate the deterioration of the catalyst mass, in the fifth embodiment.

FIG. 23 shows a control method employing the deterioration detecting means as described above. In this control method, after shifted to a state of steady combustion (step 49), newly built in is a sequence which operates at all times to judge whether the catalyst mass 1 is deteriorated or not (step 50). If YES, that is, if the catalyst mass 1 is deteriorated, the reaction gas is shut off (step 51), electrically energizing the catalyst mass 1 is shut off (step 52) and finally the whole combustion apparatus is stopped FIG. 24 shows a control method employing indication means which monitors the deterioration of the catalyst mass 1. In this control method, if the catalyst mass 1 is judged as deteriorated (step 50), the reaction gas is shut off (step 51), then electrically energizing the catalyst mass 1 is shut off (step 52) and the catalyst deterioration indication means is switched on (step 53). For example, a red lamp lights up to let known the fact the catalyst has been deteriorated and the apparatus is shut off.

In summary, according to the first embodiment of the present invention, the self heating by electrically energizing the catalyst mass takes care of preheating the catalyst mass. Consequently, compared to the conventional indirect heating where the heating medium such as air is used, there is no energy wasted, so that preheating takes place only for a short time to prepare for the ignition. Moreover, the catalyst mass is uniformly preheated through, thus realizing a clean-air ignition without producing the unwanted unburnt gas.

According to the second embodiment, the temperature range of catalyst mass is so controlled by controlling the electric energizing level of catalyst mass that the catalyst mass remains sufficiently active all the while the combustion takes place. As a result, the temperature the catalyst mass is kept constant regardless of the reaction gas quantity, thereby the lower limit of combustion quantity can be expanded to almost zero level. Thus, the variable range of heating capacity can be expanded almost without limit, thereby realizing a combustion apparatus which is capable of operating without a conventional on-off switching and giving an efficient and comfortable heating condition and which is durable having a long life-span.

According to the third embodiment, there is further employed in addition to the second embodiment a method in which the deterioration the of catalyst mass is detected when the real electric energizing level becomes greater than that which is functionally determined against the reaction gas quantity. Thus, a decline in room temperature is prevented by controlling the electric energizing level to keep up with the optimum temperature suitable for catalyst activation even when the catalyst mass is deteriorated to an endurable degree. Moreover, the deterioration of the catalyst mass can be timely detected without producing the unburnt gas, thus realizing a clean-air type highly efficient catalytic combustion apparatus.

Besides those already mentioned above, many modifications and variations of the above embodiments may be made without departing from the novel and advantageous features of the present invention. Accordingly, all such modifications and variations are intended to be included within the scope of the appended claims.

What is claimed is:

1. A method of catalytic combustion, comprising the steps of:

electrically energizing a conductive self-heating type catalyst;

supplying reaction gas comprising a mixture of fuel and air to the catalyst;

detecting a temperature of the catalyst;

igniting the reaction gas using the catalyst; and controlling the level of the electrical energizing;

wherein the igniting step comprises the sequential steps of:

preheating the catalyst by electrically energizing the catalyst mass before the reaction gas is supplied; and supplying the reaction gas to the catalyst when the catalyst temperature becomes greater than a predetermined minimum temperature which is sufficiently active against the reaction gas; and wherein, during the catalytic combustion, the catalyst temperature is controlled at a constant value by controlling the level of electrical energization of the catalyst in a manner that the level of electrical energization is increased when the quantity of reaction gas is relatively small while the level of electrical energization is lowered when the quantity of reaction gas is relatively big.

2. A catalytic combustion apparatus comprising:

a conductive self-heating type catalyst (referred to as a catalyst hereinafter) including electrodes for supplying power source to the catalyst; and electrically energizing means for energizing electrically the catalyst, wherein the catalyst is such that a catalyst support is coated which catalyst support is made of material selected from the group consisting of SiC, $TiB_2$, ceramic mainly made of SIC, and ceramic mainly made of $TiB_2$; and wherein a cross section orthogonal to reaction-gas flow direction is a disc shape, insulating means is provided so as to divide the catalyst in two portions, and an electrode is provided in each peripheral portion of the catalyst divided in two portions.

3. A catalytic combustion apparatus comprising:

a conductive self-heating type catalyst (referred to as a catalyst hereinafter) including electrodes for supplying power source to the catalyst; and electrically energizing means for energizing electrically the catalyst, wherein the catalyst is such that a catalyst support is coated which catalyst support is made of material selected from the group consisting of SiC, $TiB_2$, ceramic mainly made of SIC, and ceramic mainly made of $TiB_2$; and wherein a cross section orthogonal to reaction-gas flow direction is a disc shape, insulating means is provided so as to divide the catalyst in two portions, and an electrode is provided in each peripheral portion of the catalyst divided in two portions; and wherein a distance between the two divided portions of the catalyst is equal or less than a distance between adjacent unit cells of the catalyst.

4. A catalytic combustion apparatus comprising:

a conductive self-heating type catalyst (referred to as a catalyst hereinafter) including electrodes for supplying power source to the catalyst;

electrically energizing means for energizing electrically the catalyst;

reaction gas supply means for supplying reaction gas comprising fuel and air to the catalyst;

temperature detection means for detecting a temperature of the catalyst; and control means by which the electrically energizing means are so controlled at the time of ignition that the catalyst is preheated to a predetermined temperature and the reaction gas supply means is so controlled that the reaction gas is supplied to the catalyst after the temperature detected by the temperature detection means reaches the predetermined preheating temperature, wherein a pair of electrodes are disposed counter to each other with the catalyst therebetween, and around the electrodes there is provided a small portion that is not coated with catalyst; and wherein a radiation fin is provided with the electrodes.

5. A catalytic combustion apparatus comprising:

a conductive self-heating type catalyst (referred to as a catalyst hereinafter) including electrodes for supplying power source to the catalyst;

electrically energizing means for energizing electrically the catalyst;

reaction gas supply means for supplying reaction gas comprising fuel and air to the catalyst;

temperature detection means, provided in an upstream side over the catalyst, for detecting a temperature of the catalyst, wherein the temperature of the catalyst is detected by a non-contact type infrared detector; and control means by which the electrically energizing means are so controlled at the time of ignition that the catalyst is preheated to a predetermined temperature and the reaction gas supply means is so controlled that the reaction gas is supplied to the catalyst after the temperature detected by the temperature detection means reaches the predetermined preheating temperature.

6. A catalytic combustion apparatus comprising:

a conductive self-heating type catalyst (referred to as a catalyst hereinafter) including electrodes for supplying power source to the catalyst;

electrically energizing means for energizing electrically the catalyst;

reaction gas supply means for supplying reaction gas comprising fuel and air to the catalyst;

temperature detection means for detecting a temperature of the catalyst, wherein the temperature of the catalyst is detected in a manner that an electric resistance of the catalyst represents the temperature of the catalyst thereof according to a functional relationship between the electric resistance and the temperature of the catalyst; and control means by which the electrically energizing means are so controlled at the time of ignition that the catalyst is preheated to a predetermined temperature and the reaction gas supply means is so controlled that the reaction gas is supplied to the catalyst after the temperature detected by the temperature detection means reaches the predetermined preheating temperature.

7. A catalytic combustion apparatus comprising:

a conductive self-heating type catalyst (referred to as a catalyst hereinafter) including electrodes for supplying power source to the catalyst;

electrically energizing means for energizing electrically the catalyst;

reaction gas supply means for supplying reaction gas comprising fuel and air to the catalyst;

temperature detection means for detecting a temperature of the catalyst;

control means by which the electrically energizing means are so controlled at the time of ignition that the catalyst is preheated to a predetermined temperature and the reaction gas supply means is so controlled that the reaction gas is supplied to the catalyst after the temperature detected by the temperature detection means reaches the predetermined preheating temperature; and monitor means for indicating that the catalyst is deteriorated and not usable further.

8. A catalytic combustion apparatus comprising:

a conductive self-heating type catalyst (referred to as a catalyst hereinafter) including electrodes for supplying power source to the catalyst, a catalyst support thereof being coated, and the catalyst support being made of material selected from the group consisting of SiC, $TiB_2$, ceramic mainly made of SiC, and ceramic mainly made of $TiB_2$;

electrically energizing means for energizing electrically the catalyst;

reaction gas supply means for supplying reaction gas comprising fuel and air to the catalyst;

temperature detection means for detecting a temperature of the catalyst; and control means by which the electrically energizing means are so controlled at the time of ignition that the catalyst is preheated to a predetermined temperature and the reaction gas supply means is so controlled that the reaction gas is supplied to the catalyst after the temperature detected by the temperature detection means reaches the predetermined preheating temperature, wherein a cross section orthogonal to reaction-gas flow direction is a disc shape, insulating means is provided so as to divide the catalyst in two portions, and an electrode is provided in each peripheral portion of the catalyst divided in two portions.

9. A method of catalytic combustion, comprising the steps of:

electrically energizing a conductive self-heating type catalyst (referred to as a catalyst hereinafter);

supplying reaction gas comprising a mixture of fuel and air to the catalyst;

detecting a temperature of the catalyst;

igniting the reaction gas using the catalyst;

controlling the level of the electrical energizing;

judging whether or not the reaction gas using the catalyst is ignited after the reaction gas is supplied;

switching off the electrical energization when ignited, or shutting off supply of the reaction gas when not ignited; and re-igniting the reaction gas using the catalyst at a newly predetermined temperature which is higher than the previously predetermined catalyst activation temperature after purging unburnt reaction gas, when the reaction gas using the catalyst is not ignited, wherein the igniting step comprises the sequential steps of:

preheating the catalyst by electrically energizing the catalyst mass before the reaction gas is supplied; and supplying the reaction gas to the catalyst when the catalyst temperature becomes greater than a predetermined minimum temperature which is sufficiently active against the reaction gas.

10. A method of catalytic combustion, comprising the steps of:

electrically energizing a conductive self-heating type catalyst (referred to as a catalyst hereinafter);

supplying reaction gas comprising a mixture of fuel and air to the catalyst;

detecting a temperature of the catalyst by measuring an electric resistance of the catalyst electrically energized;

igniting the reaction gas using the catalyst; and controlling the level of the electrical energizing;

wherein the igniting step comprises the sequential steps of:

preheating the catalyst by electrically energizing the catalyst mass before the reaction gas is supplied; and supplying the reaction gas to the catalyst when the catalyst temperature become greater than a predetermined minimum temperature which is sufficiently active against the reaction gas.

11. The catalytic combustion apparatus of claim 5, claim 6, or claim 7, wherein the catalyst is such that a catalyst support is coated, which catalyst support is made of ferritic stainless steel.

12. The catalytic combustion apparatus of claim 5, claim 6 or claim 7, wherein the control means is such that a preheating temperature of the catalyst is controlled to be set at a temperature higher than the initially predetermined preheating temperature, when re-igniting the reaction gas using the catalyst after the failure of initial ignition.

13. The catalytic combustion apparatus of claim 5, claim 6 or claim 7, wherein the temperature detection means is provided in a non-conductive portion of the catalyst so that the catalyst temperature is detected by a contact-type sensor attached thereon.

14. The catalytic combustion apparatus of claim 8, wherein a distance between the two divided portions of the catalyst is equal or less than a distance between adjacent unit cells of the catalyst.

15. The method of claim 9, wherein the newly predetermined temperature is greater than the previous predetermined catalyst activation temperature by 20° C. through 300° C.

16. The method of claim 9, wherein the ignition of catalyst is confirmed when B is greater than A, where A is a temperature gradient of the catalyst temperature at the start of electrically energizing the catalyst, and B is a temperature gradient when the reaction gas is supplied after the catalyst reaches the predetermined preheating temperature.

17. The catalytic combustion apparatus of claim 5, wherein the catalyst is a porous ceramic.

* * * * *